US007526232B2

(12) United States Patent
Kamimura et al.

(10) Patent No.: US 7,526,232 B2
(45) Date of Patent: Apr. 28, 2009

(54) IMAGE FORMING APPARATUS AND DRIVE UNIT OF IMAGE FORMING UNIT

(75) Inventors: Naoya Kamimura, Nagoya (JP); Yoshito Takakuwa, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 484 days.

(21) Appl. No.: 11/507,442

(22) Filed: Aug. 22, 2006

(65) Prior Publication Data

US 2007/0053719 A1 Mar. 8, 2007

(30) Foreign Application Priority Data

Sep. 6, 2005 (JP) ..... 2005-257215

(51) Int. Cl.
*G03G 15/00* (2006.01)
*G03G 21/16* (2006.01)

(52) U.S. Cl. ..... 399/167; 399/111

(58) Field of Classification Search ..... 399/111, 399/126, 167
See application file for complete search history.

(56) References Cited

U.S. PATENT DOCUMENTS 5,585,898 A 12/1996 Fujii
5,740,503 A * 4/1998 Nakamura ..... 399/167
5,970,286 A * 10/1999 Numazu et al. ..... 399/167
6,463,234 B2 * 10/2002 Arimitsu et al. ..... 399/111
6,745,695 B2 * 6/2004 Liston ..... 399/167
6,801,737 B2 * 10/2004 Yanagida ..... 399/167
6,978,105 B2 * 12/2005 Chung et al. ..... 399/167
7,283,769 B2 * 10/2007 Noh ..... 399/167
7,430,387 B2 * 9/2008 Kim et al. ..... 399/167
2004/0161263 A1 * 8/2004 Ehara ..... 399/167

FOREIGN PATENT DOCUMENTS

EP 1429201 A1 * 6/2004
JP 02066582 A * 3/1990
JP 7-248683 9/1995
JP 09179372 A * 7/1997
JP 9-277610 10/1997
JP 10-307442 11/1998
JP 11-52657 2/1999
JP 2001-277184 10/2001
JP 2002-6579 1/2002
JP 2005-156779 6/2005

* cited by examiner

*Primary Examiner*—Susan S Lee
(74) *Attorney, Agent, or Firm*—Banner & Witcoff, Ltd.

(57) ABSTRACT

A swinging gear is constructed to be swingable in accordance with the rotational direction of a main gear. A first gear train is arranged to drive a black developing unit by meshing with the swinging gear when the main gear is rotated in a first direction. A second gear train is arranged to drive developing units for colors such as yellow by meshing with the swinging gear when the main gear is rotated in a second direction reverse to the first direction.

37 Claims, 12 Drawing Sheets

IMAGE FORMING APPARATUS AND DRIVE UNIT OF IMAGE FORMING UNIT

CROSS-REFERENCE TO RELATED APPLICATIONS

This Nonprovisional application claims priority under 35 U.S.C. § 119(a) on Patent Application No. 2005-257215 filed in Japan on Sep. 6, 2005, the entire contents of which are hereby incorporated by reference.

BACKGROUND OF THE INVENTION

1. Field of the Invention

The present invention relates to an image forming apparatus constructed to be switchable between black monochromatic image forming and multicolor image forming using a plurality of image forming units. The present invention also relates to a drive unit for driving the image forming units, which are provided in the image forming apparatus for an image forming process therein and are easily detachable from the image forming apparatus.

2. Description of the Related Art

An apparatus having a plurality of developing units accommodating developers therein for developing electrostatic latent images is well-known as an image forming apparatus capable of forming multicolor images (a color image forming apparatus). In particular, such a well-known image forming apparatus includes a black developing unit accommodating a black developer, a yellow developing unit accommodating a yellow developer, a magenta developing unit accommodating a magenta developer, and a cyan developing unit accommodating a cyan developer.

When black monochromatic images are formed using the image forming apparatus having four kinds of developing units corresponding to the four-color developers mentioned above, it is not necessary to drive the developing units for developers other than that corresponding to the black monochromatic developer. In this case, there are known image forming apparatuses capable of preventing deterioration of the developing units and the developers other than black by stopping to drive the developing units other than the black developing unit (see Japanese Patent Application Laid-Open (kokai,) No. 2005-156779, No. 2002-6579, No. H10-307442, and No. H07-248683).

However, the image forming apparatuses disclosed in the above-mentioned Publications have been provided with switching mechanisms, such as a solenoid or an electromagnetic clutch, for switching between black monochromatic image forming and multi-color image forming (referred to as a switching mechanism below). This switching mechanism is only for switching between black monochromatic image forming and multi-color image forming, which is essentially irrelevant to driving of image forming mechanisms such as the developing units. Thus, providing such a switching mechanism unnecessarily complicates the structure of the image forming apparatus, increasing the apparatus cost.

SUMMARY OF THE INVENTION

The present invention has been made for solving the problems described above, and it is an object thereof to provide an image forming apparatus capable of switching the mode between monochromatic image forming and multi-color image forming with a simplified structure and a drive unit of driving image forming units being capable of switching the operation between monochromatic image forming and multi-color image forming by switching driving between a plurality of the image forming units provided in the image forming apparatus with a simplified structure.

An image forming apparatus according to the present invention includes a first-color image forming unit, a second-color image forming unit, and a third-color image forming unit. The image forming apparatus according to the present invention also includes a drive unit of the image forming unit (simply referred to as a drive unit below) for generating a rotational drive force for driving the image forming unit so as to be transmitted to each of the image forming units. The drive unit according to the present invention is constructed so as to drive a plurality of the image forming units.

The first-color image forming unit has a black developer as a first-color developer accommodated therein and includes a first drive force input part for receiving the rotational drive force from the drive unit. The second-color image forming unit has a second-color developer accommodated therein and includes a second drive force input part for receiving the rotational drive force from the drive unit. The third-color image forming unit has a third-color developer accommodated therein, which color is different from the first- and second-color, and includes a third drive force input part for receiving the rotational drive force from the drive unit. The drive unit includes a motor generating the rotational drive force.

The present invention is characterized in that the driving unit includes a main gear, a swinging gear, a first gear train, and a second gear train.

The main gear is arranged rotatable in both forward and reverse directions in accordance with the rotational direction of the motor when the rotational drive force is transmitted thereto from the motor. The swinging gear is arranged so as to mesh with the main gear and constructed to be swingable between a first position and a second position by the rotational drive force transmitted to the main gear in accordance with the rotational direction of the motor. The first gear train is constructed so as to transmit the rotational drive force of the main gear to the first drive force input part by meshing with the swinging gear when the swinging gear is swung to the first position by the rotation of the main gear in the first direction. The second gear train is constructed so as to transmit the rotational drive force of the main gear to the second and third drive force input parts by meshing with the swinging gear when the swinging gear is swung to the second position by the rotation of the main gear in the second direction.

In such a structure, during black monochromatic image forming, the motor is driven so as to rotate the main gear in the first direction. Then, the rotational drive force transmitted to the main gear is in turn transmitted to the swinging gear so as to swing it to the first position. By the swinging of the swinging gear to the first position, the swinging gear is meshed with the first gear train. Then, the rotational drive force of the main gear rotating in the first direction is transmitted to the first drive force input part via the swinging gear. Thereby, the first-color image forming unit having the black developer accommodated therein is driven so as to form black monochromatic images.

On the other hand in such a structure, during multicolor image forming, the motor is rotated in a direction reverse to the direction of the above case (the case during monochromatic image forming) so as to rotate the main gear in the second direction. Then, the rotational drive force transmitted to the main gear is in turn transmitted to the swinging gear so as to swing it to the second position. By the swinging of the swinging gear to the second position, the swinging gear is meshed with the second gear train. Then, the rotational drive force of the main gear rotating in the second direction is transmitted to the second and third drive force input parts via the swinging gear. Thereby, the second-color image forming unit having the second-color developer accommodated therein and the third-color image forming unit having the third-color developer accommodated therein are driven so as to form multicolor images with the second-color and the third-color.

In such a manner, according to the structure, an advantage can be obtained in that the switching between monochromatic image forming and color image forming can be made only by reversing the rotational direction of the single motor with a very simplified structure.

In the second-color image forming unit, the black developer may be accommodated as the second-color developer. That is, the first-color image forming unit is a dedicated unit for black monochromatic image forming while the second-color image forming unit is for exclusive use in developing black parts during multicolor image forming.

In such a structure, during black monochromatic image forming, in the same way as that mentioned above, the main gear is rotated by the motor in the first direction so as to swing the swinging gear to the first position. Then, the rotational drive force from the motor is transmitted to the first drive force input part via the swinging gear and the first gear train. Thereby, the first-color image forming unit having the black developer accommodated therein is driven.

On the other hand in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second and third drive force input parts via the swinging gear and the second gear train. Thereby, the second-color image forming unit having the black developer as the second-color developer accommodated therein and the third-color image forming unit having the third-color developer different from the black developer accommodated therein are driven so as to form multicolor images with the second-color, which is black, and the third-color. That is, during multicolor image forming, black parts of the multicolor images are formed by the second-color image forming unit with stopping the first-color image forming unit.

In such a structure, during multicolor image forming, brilliant black part images in the multicolor images can be formed without an additional gear train. Hence, according to the structure, an advantage can be obtained in that the gear configuration of the drive unit is more simplified.

The image forming apparatus may further include a third gear train so that the first gear train and the third gear train are configured so as to have an odd-numbered difference in the number of gears between the first gear train and the third gear train. The third gear train herein is constructed so as to transmit the rotational drive force of the main gear rotating in the second direction to the first drive force input part by meshing with the swinging gear when the swinging gear is swung to the second position by the rotation of the main gear in the second direction.

In such a structure, during black monochromatic image forming, the main gear is rotated in the first direction based on the rotation of the motor. Then, as in the same way as that mentioned above, the swinging gear is swung to the first position, and the rotational drive force is transmitted to the first drive force input part from the motor via the swinging gear and the first gear train. Thereby, the first-color image forming unit having the black developer accommodated therein is driven so as to form black images.

On the other hand, during multicolor image forming, the motor is rotated in a direction reverse to the direction of the above case (the case during monochromatic image forming) so as to rotate the main gear in the second direction and so as to swing the swinging gear to the second position. The swinging gear swung to the second position is meshed with the second gear train and the third gear train. Then, the rotational drive force from the motor is transmitted to the second and third drive force input parts via the swinging gear and the second gear train. Thereby, the second-color image forming unit and the third-color image forming unit are driven. Also, the rotational drive force from the motor is transmitted to the first drive force input part via the swinging gear and the third gear train so as to drive the first-color image forming unit. At this time, since the difference in number of gears between the first gear train and the third gear train is odd-numbered, to the first-color image forming unit, the rotational drive force can be transmitted in the same rotational direction as that during black monochromatic image forming. Thereby, multicolor images are formed with the first-color, which is black, the second-color (different from black in this case), and the third-color (different from black and the second-color).

By such a structure, during the black monochromatic image forming and the multicolor image forming, the first-color image forming unit accommodating the black developer can be shared with a very simplified structure. Therefore, according to the structure, the switching between black monochromatic image forming and multicolor image forming can be effectively made with a very simplified structure.

The first gear train and the third gear train may be arranged at positions separated from the motor further than that of the second gear train. That is, in such a structure, the second gear train for transmitting the rotational drive force to the second-color image forming unit and the third-color image forming unit is arranged at a position closer to the motor than the first gear train.

In such a structure, the second gear train for driving a plurality of the image forming units is arranged in a position closer to the motor than the first gear train for driving the single image forming unit. According to the structure, by arranging the second gear train receiving a comparatively large load at the position close to the motor, the transmission efficiency of the rotational drive force in the second gear train can be effectively improved. Also, according to the structure, by arranging the first gear train in an open space outside the second gear train, the drive unit of the image forming apparatus can be efficiently miniaturized easily in size.

Part of a plurality of gears constituting the third gear train may include a gear constituting the first gear train.

In such a structure, an advantage can be obtained in that the gear configuration of the drive unit is further simplified.

The first gear train may include a first input gear arranged to be connected to the first drive force input part, and the second gear train may include a second input gear arranged to be connected to the second drive force input part and a third input gear arranged to be connected to the third drive force input part, and the first input gear, the second input gear, and the third input gear may be configured to have the same pitch circle diameter.

In such a structure, the unification of the drive speed of the first- to third-color image forming units can be achieved by unifying the peripheral speeds of the first to third input gears with a simple structure. Thus, according to the structure, multicolor images with stable image quality can be formed with a simple structure.

The first input gear, the second input gear, and the third input gear may be configured to have the same number of teeth.

According to the structure, the unification of driving states of the first-color image forming unit, the second-color image forming unit, and the third-color image forming unit can be achieved by unifying the rotational drive states of the first input gear, the second input gear, and the third input gear with simple structure. Thus, according to the structure, multicolor images with stable image quality can be formed with a simple structure.

The motor may be a DC motor.

According to the structure, an advantage is obtained in that a plurality of the image forming units can be stably driven by driving the second gear train.

The image forming unit may be a developing unit capable of developing electrostatic latent images with the developer. That is, the first-color image forming unit is composed of a first-color developing unit capable of developing electrostatic latent images with the black developer; the second-color image forming unit is composed of a second-color developing unit capable of developing electrostatic latent images with the second-color developer; and the third-color image forming unit is composed of a third-color developing unit capable of developing electrostatic latent images with the third-color developer.

In such a structure, during black monochromatic image forming, in the same way as that described above, the main gear is rotated by the motor in the first direction so as to swing the swinging gear to the first position. Then, the rotational drive force from the motor is transmitted to the first drive force input part via the swinging gear and the first gear train. Thereby, the first-color developing unit having the black developer accommodated therein is driven so as to form black images.

On the other hand, in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second and third drive force input parts via the swinging gear and the second gear train. Thereby, the second-color developing unit having the second-color developer accommodated therein and the third-color developing unit having the third-color developer accommodated therein are driven.

In this case, by the swinging gear meshing with the third gear train, the first-color developing unit may also be driven via the third gear train and the first drive force input part.

In such a manner, according to the image forming apparatus of the present invention, an advantage can be obtained in that the switching between monochromatic image forming and multicolor image forming can be made only by reversing the rotational direction of the single motor, which is a drive power supply of each developing unit, with a very simplified structure.

The image forming apparatus may further include a first process unit and a second process unit.

The first process unit has the first-color developing unit detachably accommodated therein and a first-color image carrying drum constructed so as to form electrostatic latent images on its peripheral surface and arranged opposite the first-color developing unit.

The second process unit has the second-color developing unit and the third-color developing unit detachably accommodated therein. Also, the second process unit has a second-color image carrying drum capable of forming electrostatic latent images on its peripheral surface and arranged opposite the second-color developing unit and a third-color image carrying drum capable of forming electrostatic latent images on its peripheral surface and arranged opposite the third-color developing unit.

In such a structure, during black monochromatic image forming, in the same way as that described above, the main gear is rotated by the motor in the first direction so as to swing the swinging gear to the first position. Then, the rotational drive force from the motor is transmitted to the first drive force input part via the swinging gear and the first gear train. Then, the first process unit is driven. That is, the first-color image carrying drum and the first-color developing unit mounted on the first process unit are driven. Thereby, the electrostatic latent images formed on the peripheral surface of the first-color image carrying drum are developed with the black developer.

On the other hand, in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second and third drive force input parts via the swinging gear and the second gear train. Then, the second process unit is driven. That is, the second-color image carrying drum, the third-color image carrying drum, the second-color developing unit, and the third-color developing unit mounted on the second process unit are driven. Thereby, the electrostatic latent images formed on the peripheral surfaces of the second-color image carrying drum and the third-color image carrying drum are developed with the second-color developer and the third-color developer, respectively.

In this case, by the swinging gear meshing with the third gear train, the first process unit may also be driven via the swinging gear, the third gear train, and the first drive force input part.

According to the structure, when the black developer with high frequency of use is reduced faster than the other developers, an advantage of easy maintenance of the image forming apparatus may be obtained.

The first drive force input part may be connected to a first-color drum gear fixed to an end of the first-color image carrying drum in its longitudinal direction so as to transmit the rotational drive force from the drive unit to the first-color developing unit; the second drive force input part may be connected to a second-color drum gear fixed to an end of the second-color image carrying drum in its longitudinal direction so as to transmit the rotational drive force from the drive unit to the second-color developing unit; and the third drive force input part may be connected to a third-color drum gear fixed to an end of the third-color image carrying drum in its longitudinal direction so as to transmit the rotational drive force from the drive unit to the third-color developing unit.

In such a structure, during black monochromatic image forming, in the same way as that described above, the main gear is rotated by the motor in the first direction so as to swing the swinging gear to the first position. Then, the rotational drive force from the motor is transmitted to the first drive force input part and the first-color drum gear via the swinging gear and the first gear train. Then, the rotational drive force is transmitted to the first-color developing unit via the first-color drum gear. Thereby, the electrostatic latent images formed on the peripheral surface of the first-color image carrying drum are developed with the black developer.

On the other hand, in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second drive force input part and the second-color drum gear via the swinging gear and the second gear train. Also, the rotational drive force is transmitted to the third drive force input part and the third-color drum gear. Then, the rotational drive force is transmitted to the second-color developing unit and the third-color developing unit via the second-color drum gear fixed to the end of the second-color image carrying drum and the third-color drum gear fixed to the end of the third-color image carrying drum. Thereby, the electrostatic latent images formed on the peripheral surfaces of the second-color image carrying drum and the third-color image carrying drum are developed with the second-color developer and the third-color developer, respectively.

According to the structure, the switching between black monochromatic image forming and multicolor image forming can be effectively made with a very simplified structure.

The image forming unit may be a process unit having an image carrying drum capable of forming electrostatic latent images on its peripheral surface and a developing unit capable of developing the electrostatic latent images on the peripheral surface of the image carrying drum and arranged opposite the image carrying drum. The process unit is easily detachably mounted on a body of the image forming apparatus.

That is, a first-color process unit as the first-color image forming unit includes a first-color developing unit capable of developing electrostatic latent images with the black developer and a first-color image carrying drum arranged opposite the first-color developing unit; a second-color process unit as the second-color image forming unit includes a second-color developing unit capable of developing electrostatic latent images with the second-color developer and a second-color image carrying drum arranged opposite the second-color developing unit; and a third-color process unit as the third-color image forming unit includes a third-color developing unit capable of developing electrostatic latent images with the third-color developer and a third-color image carrying drum arranged opposite the third-color developing unit.

In such a structure, during black monochromatic image forming, in the same way as that described above, the main gear is rotated by the motor in the first direction so as to swing the swinging gear to the first position. Then, the rotational drive force from the motor is transmitted to the first drive force input part of the first-color process unit via the swinging gear and the first gear train. Thereby, the first-color image carrying drum and the first-color developing unit are driven, and the electrostatic latent images formed on the peripheral surface of the first-color image carrying drum are developed with the black developer.

On the other hand, in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second drive force input part of the second-color process unit and the third drive force input part of the third-color process unit via the swinging gear and the second gear train. Thereby, the second-color image carrying drum, the third-color image carrying drum, the second-color developing unit, and the third-color developing unit are driven, and the electrostatic latent images formed on the peripheral surfaces of the second-color image carrying drum and the third-color image carrying drum are developed with the second-color developer and the third-color developer, respectively.

In this case, by the swinging gear meshing with the third gear train, the first-color process unit may also be driven via the swinging gear, the third gear train, and the first drive force input part.

According to the structure, when a certain color developer with high frequency of use is reduced faster than other developers, an advantage of easy maintenance of the image forming apparatus may be obtained.

The first drive force input part may be connected to a first-color drum gear fixed to an end of the first-color image carrying drum in its longitudinal direction so as to transmit the rotational drive force from the drive unit to the first-color developing unit; the second drive force input part is connected to a second-color drum gear fixed to an end of the second-color image carrying drum in its longitudinal direction so as to transmit the rotational drive force from the drive unit to the second-color developing unit; and the third drive force input part is connected to a third-color drum gear fixed to an end of the third-color image carrying drum in its longitudinal direction so as to transmit the rotational drive force from the drive unit to the third-color developing unit.

In such a structure, during black monochromatic image forming, in the same way as that described above, the main gear is rotated by the motor in the first direction so as to swing the swinging gear to the first position. Then, the rotational drive force from the motor is transmitted to the first drive force input part and the first-color drum gear via the swinging gear and the first gear train. Thereby, the first-color image carrying drum is rotated. Furthermore, the rotational drive force is transmitted to the first-color developing unit via the first-color drum gear. In such a manner, when the rotational drive force from the motor is transmitted to the first-color process unit via the swinging gear and the first gear train, the first-color process unit is driven. Then, the electrostatic latent images formed on the peripheral surface of the first-color image carrying drum are developed with the black developer.

On the other hand, in such a structure, during multicolor image forming, in the same way as that mentioned above, the motor is rotated in a direction reverse to the direction during monochromatic image forming so as to rotate the main gear in the second direction and so as to swing the swinging gear to the second position. Then, the rotational drive force from the motor is transmitted to the second drive force input part and the second-color drum gear via the swinging gear and the second gear train. Also, the rotational drive force is transmitted to the third drive force input part and the third-color drum gear. Thereby, the second-color image carrying drum and the third-color image carrying drum are driven. Furthermore, the rotational drive force is transmitted to the second-color developing unit and the third-color developing unit via the second-color drum gear and the third-color drum gear. In such a manner, when the rotational drive force from the motor is transmitted to the second-color process unit and the third-color process unit via the swinging gear and the second gear train, the second-color process unit and the third-color process unit are driven, and the electrostatic latent images formed on the peripheral surfaces of the second-color image carrying drum and the third-color image carrying drum are developed with the second-color developer and the third-color developer, respectively.

According to the structure, the switching between black monochromatic image forming and multicolor image forming can be effectively made with a very simplified structure.

DESCRIPTION OF THE PREFERRED EMBODIMENTS

An embodiment of the present invention (the best mode embodiment considered by the applicant (inventor) for the application time being) will be described with reference to the drawings.

(Schematic Structure of Laser Printer)

Figure 1:
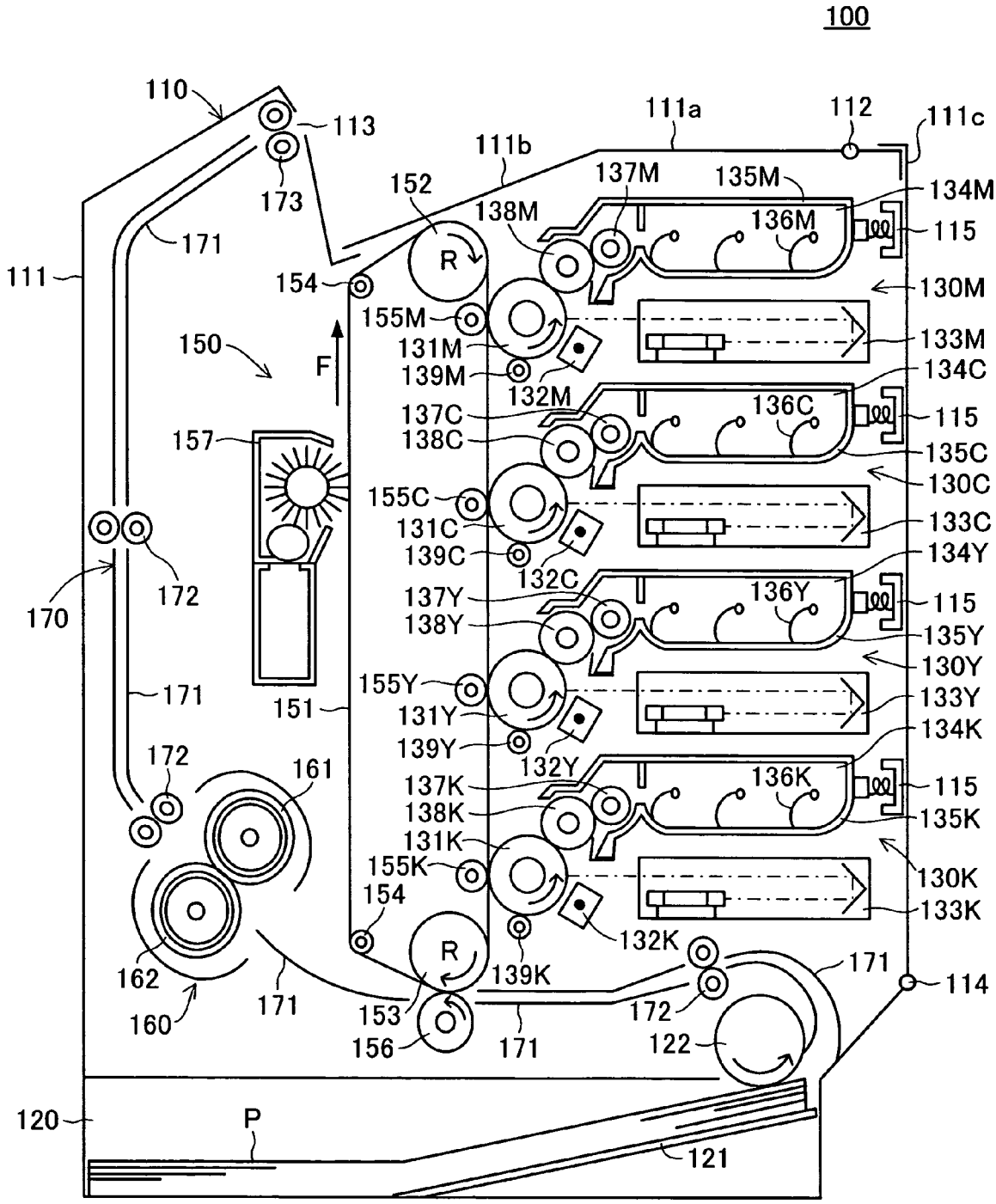
FIG. 1 is a schematic sectional view of a color laser printer according to an embodiment of the present invention.

FIG. 1 is a side sectional view of a color laser printer 100 according to the embodiment of the image forming apparatus of the present invention. The color laser printer 100 includes a body 110 and a sheet feed section 120 for feeding a recoding medium (sheet of paper: hereinafter referred as "sheet P") to the body 110.

Inside the body 110, a plurality of image forming units 130 (130M, 130C, 130Y, and 130K) are arranged in the vertical direction. A transfer section 150 is arranged opposite the plurality of the image forming units 130M, 130C, 130Y, and 130K. The transfer section 150 is constructed so as to transfer the developer (toner), image-like carried on the peripheral surfaces of photosensitive drums 131 (131M, 131C, 131Y, and 131K) respectively provided in the image forming units 130 (130M, 130C, 130Y, and 130K), to a sheet P.

Inside the body 110, a fixing unit 160 is arranged for fixing toner images transferred on the sheet P by the transfer section 150. Inside the body 110, a sheet conveying section 170 is also arranged for conveying the sheet P fed from the sheet feed section 120 to the transfer section 150 and the fixing unit 160 as well as for outside ejecting the sheet P which has passed through the fixing unit 160.

(Structure of Body)

A body cover 111 is a substantially rectangular parallelepiped member constituting the casing of the body 110, and is integrally formed of a synthetic resin plate. The body cover 111 is arranged so as to cover a main frame (not shown) for supporting the above-mentioned sections accommodated in the body 110.

The body cover 111 is provided with an upper surface cover 111*a* arranged in the upper portion. The upper surface cover 111*a* is rotatably supported by an upper surface cover rotational shaft 112 at the end of the front face (on the right of FIG. 1 and so forth). That is, the upper surface cover 111*a* is arranged so as to be openable in the substantially vertical direction by rotating about the upper surface cover rotational shaft 112. The upper surface cover 111*a* is provided with a catch tray 111*b* formed thereon. The catch tray 111*b* constitutes an inclined surface obliquely downward extending from the front face toward the back face (on the left of FIG. 1 and so forth). A sheet ejection port 113 is formed in the upper side of the lower end (the end of the back face side) of the catch tray 111*b* on the upper portion of the body cover 111. The sheet ejection port 113 is an opening for outside ejecting the sheet P having toner images formed thereon, and is slit like formed longitudinally in the width wise direction of the sheet P (in the direction perpendicular to the figure of FIG. 1 and so forth). That is, the catch tray 111*b* is structured so as to receive the sheet P having images formed thereon ejected from the sheet ejection port 113.

On the front face of the body cover 111, an opening is formed so as to outside expose the plurality of the image forming units 130M, 130C, 130Y, and 130K accommodated within the body 110 for detachably forming them. Then, a front face cover 111*c* is mounted so as to cover the opening. The front face cover 111*c* is rotationally supported by a front face cover rotational shaft 114 integrally formed with the body cover 111 at its lower end. That is, the front face cover 111*c* is arranged so as to be openable in the substantially back and forth direction by rotating about the front face cover rotational shaft 114.

Inside the front face cover 111*c*, a plurality of image forming unit urging members 115 are arranged so as to respectively correspond to the plurality of the image forming units 130M, 130C, 130Y, and 130K the image forming unit urging members 115 is constructed so as to urge developing units 134 (134M, 134C, 134Y, and 134K), which are respectively provided in the image forming units 130 and will be described later, toward the photosensitive drums 131 (131M, 131C, 131Y, and 131K).

(Structure Sheet Feed Section)

Inside the sheet feed section 120, a sheet tray 121 is arranged so as to have a number of the sheets P laid thereon. A sheet feed roller 122 is arranged so as opposite an end portion of the sheet tray 121 on the front face side. The peripheral surface of the sheet feed roller 122 is made of a material with a high frictional coefficient such as rubber. The sheet feed section 120 is constructed so as to convey the sheet P toward the inside of the body 110 by rotating the sheet feed roller 122 in arrow direction of the drawing.

(Structure Image Forming Unit)

The image forming units 130 (130M, 130C, 130Y, and 130K) include the photosensitive drums 131, scorotron chargers 132, exposure units 133, and developing units 134. The structure of the image forming units 130 will be described below in detail. In addition, subscripts "M", "C", "Y", and "K" added to numerals in the drawings denote "magenta", "cyan", "yellow", and "black", respectively. They correspond to kinds (colors) of toner accommodated in the corresponding image forming units 130. In the description of the structure of the image forming units 130, these subscripts are omitted in the convenience sake.

The photosensitive drum 131 is a cylindrical member longitudinal in the width wise direction of the sheet P so as to have electrostatic latent images formed on its peripheral surface. The photosensitive drum 131 is supported by the body 110 (the above-mentioned not shown main frame) so as to be rotated in arrow direction of the drawing. The photosensitive drum 131 is arranged so that its peripheral end portion on the back face side opposes the transfer section 150 (below-mentioned intermediate transfer belt).

The scorotron charger 132 is arranged in close vicinity to the photosensitive drum 131. That is, the scorotron charger 132 is arranged so as opposite a portion of the peripheral surface of the photosensitive drum 131 on the downstream side in the rotational direction of the photosensitive drum 131 further than the portion opposing the transfer section 150. The scorotron charger 132 is constructed to uniformly charge the peripheral surface of the photosensitive drums 131 opposing thereto.

The exposure unit 133 is arranged so as opposite a portion of the peripheral surface of the photosensitive drum 131 on the downstream side in the rotational direction of the photosensitive drum 131 further than the portion opposing the scorotron charger 132. The exposure unit 133 is capable of forming electrostatic latent images on the peripheral surface of the photosensitive drum 131 uniformly charged with the scorotron charger 132 by irradiating the peripheral surface with a laser beam (shown by a dash-dotted line in the drawing) in accordance with image data.

(Structure of Developing Unit)

The developing unit 134 is arranged so as opposite a portion of the peripheral surface of the photosensitive drum 131 on the downstream side in the rotational direction of the photosensitive drum 131 further than the portion opposing the exposure unit 133. The developing unit 134 is constructed so as to be detachably mounted on the body 110 (the above-mentioned not shown main frame) via the opening on the front face side (on the right in the drawing) of the body 110 by opening the front face cover 111*c* of the body 110.

The developing unit 134 is arranged opposite the photosensitive drum 131 so that toner images can be formed on the peripheral surface of the photosensitive drum 131 by developing the electrostatic latent images formed thereon with toner. That is, the developing unit 134 is constructed so as to supply toner on the peripheral surface of the photosensitive drum 131. The specific structure of the developing unit 134 is as follows.

The developing unit 134 includes a developing unit case 135, agitators 136, a feed roller 137, and a developing roller 138. The developing unit case 135 is a box-like member constituting the casing of the developing unit 134. Toner is accommodated in a space within the developing unit case 135. Within the space having the toner accommodated therein in the developing unit case 135, the agitators 136 are arranged. The agitators 136 are constructed so as to agitate the toner in the space as well as to supply the toner toward the feed roller 137 in small portions by being rotated. The feed roller 137 and the developing roller 138 are arranged in the vicinity of the opening formed at the end of the developing unit case 135.

The feed roller 137 is a cylindrical member longitudinal in the width wise direction of the sheet P, and is composed of a metallic rotational center shaft and an outer layer made of a spongy form formed in the periphery of the rotational center shaft. The feed roller 137 is arranged toward the inside of the developing unit case 135 at a position further than the developing roller 138 so as to come in touch with the peripheral surface of the developing roller 138 or to be pressurized thereby. The feed roller 137 is also supported rotatably by the developing unit case 135. The feed roller 137 is constructed so as to carry the charged toner on the peripheral surface of the developing roller 138 by being rotated during the image forming.

The developing roller 138 is a cylindrical member longitudinal in the width wise direction of the sheet P, and is composed of a metallic rotational center shaft and an outer layer made of semiconductive rubber formed in the periphery of the rotational center shaft. The developing roller 138 is accommodated within the developing unit case 135 so that about the half of its peripheral surface is exposed outside the developing unit case 135 via the above-mentioned opening. The developing roller 138 is also supported rotatably by the developing unit case 135. Furthermore, the developing unit case 135 used for image formation is urged by the image forming unit urging member 115 so that the developing roller 138 is arranged so as to have a predetermined positional relationship between the peripheral surfaces of the developing roller 138 and the photosensitive drum 131 (coming in touch with each other at a predetermined pressure or opposing each other leaving a predetermined space therebetween). The developing roller 138 is constructed so as to supply the toner carried on the peripheral surface of the developing roller 138 to the peripheral surface of the photosensitive drum 131 by being rotated during the image forming.

When the developing unit case 135 is not driven, it is constructed so that the developing roller 138, which is not driven, is separated from the photosensitive drum 131 by being moved by moving means (not shown) in a direction opposite to the urging direction of the image forming unit urging members 115 (on the right of the drawing). Such moving means may include a cam mechanism and a solenoid.

A cleaning roller 139 is arranged so as opposite a portion of the peripheral surface of the photosensitive drum 131 on the upstream side in the rotational direction of the photosensitive drum 131 further than the portion opposing the scorotron charger 132. The cleaning roller 139 is constructed so as to remove toner and dust from the peripheral surface of the photosensitive drum 131 immediately before the drum is uniformly charged by the scorotron charger 132.

(Structure of Transfer Section)

The transfer section 150 includes an intermediate transfer belt 151, belt drive rollers 152 and 153, belt guide rollers 154, primary transfer rollers 155, a secondary transfer roller 156, and a belt cleaner 157.

The endless intermediate transfer belt 151 is made of a conductive plastic formed by dispersing conductive particles, such as carbon, into a synthetic resin such as polycarbonate and polyimide.

The belt drive roller 152 is arranged at substantially the same height as that of the image forming unit 130M which is positioned at the top. On the other hand, the belt drive roller 153 is arranged at the lowest position of the body 110 as well as at a potion lower than that of the image forming unit 130K which is positioned at the bottom. The belt drive roller 153 is also arranged so as opposite the sheet conveying path of the sheet conveying section 170.

The intermediate transfer belt 151 is stretched around the outer surfaces of the belt drive roller 152, the belt drive roller 153, and the belt guide rollers 154, and has an appropriate tension established by the belt guide rollers 154. When the belt drive rollers 152 and 153 are driven in arrow R direction of the drawing, the intermediate transfer belt 151 is arranged so as to proceed in arrow F direction of the drawing.

The primary transfer roller 155 is arranged so as opposite the photosensitive drum 131 with the intermediate transfer belt 151 therebetween. To the primary transfer roller 155, a high-voltage power supply is electrically connected, so that a primary transfer bias voltage can be applied across the primary transfer roller 155 and the photosensitive drum 131 for transferring toner from the peripheral surface of the photosensitive drum 131 to the intermediate transfer belt 151.

The secondary transfer roller 156 is arranged so as opposite the belt drive roller 153 with the sheet conveying path therebetween at a position below the belt drive roller 153. To the secondary transfer roller 156, a high-voltage power supply is electrically connected, so that a secondary transfer bias voltage can be applied across the secondary transfer roller 156 and the belt drive roller 153 for transferring toner from the intermediate transfer belt 151 to the sheet P.

The belt cleaner 157 is arranged so as opposite the surface of the intermediate transfer belt 151. The belt cleaner 157 is constructed so as to clean the surface of the intermediate transfer belt 151.

(Structure of Fixing Unit)

The fixing unit 160 is arranged at a position on the downstream side in the sheet conveying direction further than a position the belt drive roller 135 opposes the secondary transfer roller 156 (referred to as a secondary transfer position below). The fixing unit 160 includes a heating roller 161 and a pressure roller 162. The heating roller 161 is composed of a metallic thin-wall hollow cylindrical member with a released surface and a halogen lamp arranged inside the thin-wall hollow cylindrical member. The pressure roller 162 is a roller made of silicon rubber, and is arranged so as to pressurize the heating roller 161 at a predetermined pressure. The heating roller 161 and the pressure roller 162 are constructed so that the sheet P having toner transferred thereon at the secondary transfer position can be conveyed toward a sheet ejection port 113 while being pressurized and heated.

(Structure of Sheet Conveying Section)

The sheet conveying section 170 is composed of a plurality of sheet guides 171, a plurality of sheet conveying rollers 172, and sheet ejection rollers 173. The sheet guides 171 and the sheet conveying rollers 172 are constructed so that the sheet P can be conveyed from the sheet feed section 120 toward the sheet ejection rollers 173 via the secondary transfer position and the fixing unit 160. The sheet ejection rollers 173 are a pair of rollers rotated by a motor (not shown), and are arranged in the vicinity of the sheet ejection port 113.

(Structure of Drive Unit)

Then, the specific structure of a drive unit for driving the image forming unit 130, which is an essential part of the color laser printer 100 according to the embodiment, will be described.

Figure 2:
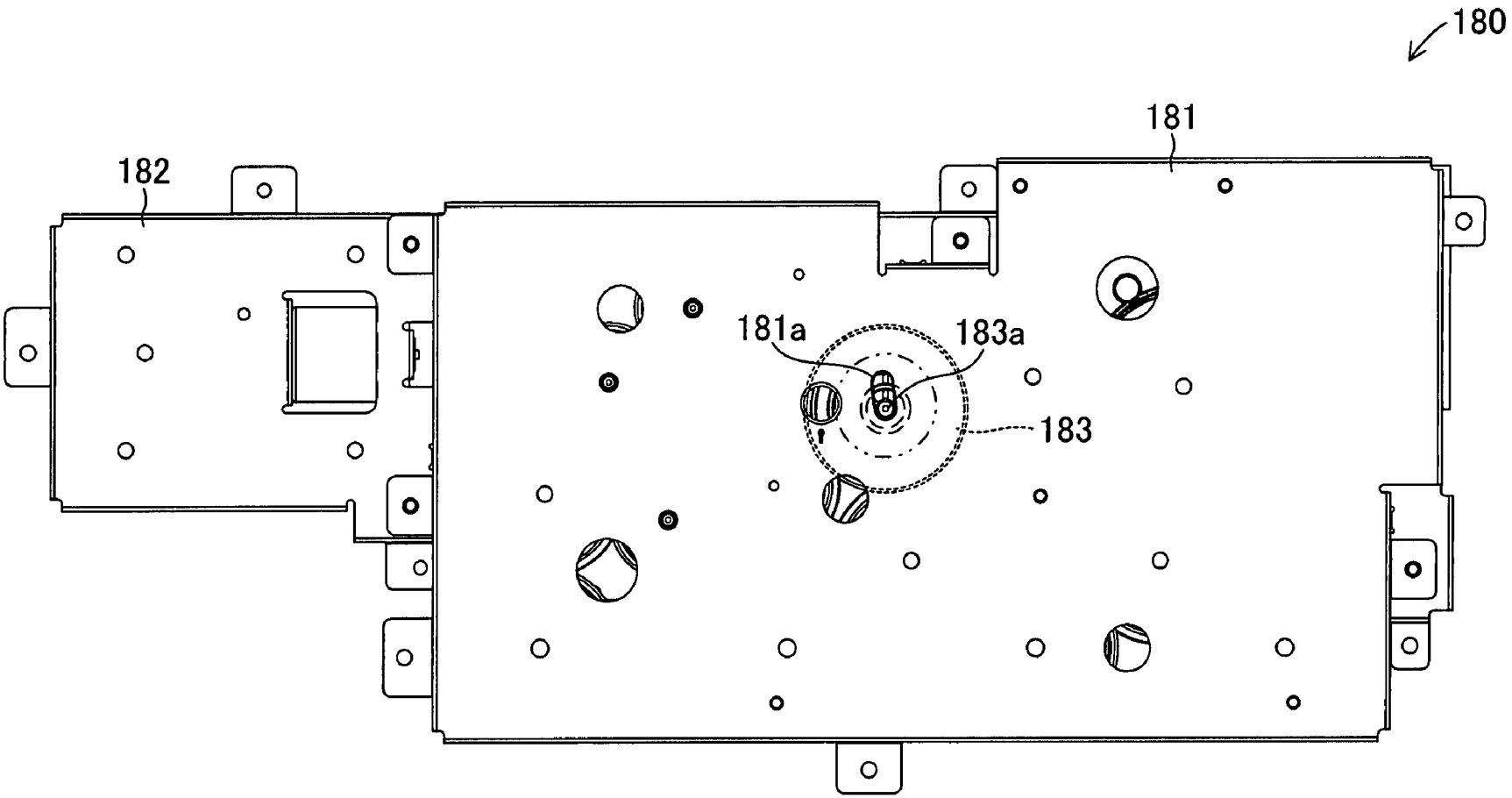
FIG. 2 is an external view of a drive unit provided in the color laser printer shown in FIG. 1.

FIG. 2 is an external view of a drive unit 180 according to the embodiment. Referring to FIG. 2, a first side frame 181 and a second side frame 182 are plate members constituting the casing of the drive unit 180. Between the first side frame 181 and the second side frame 182, a number of gears including a swinging gear 183 are rotatably supported.

Figure 3:
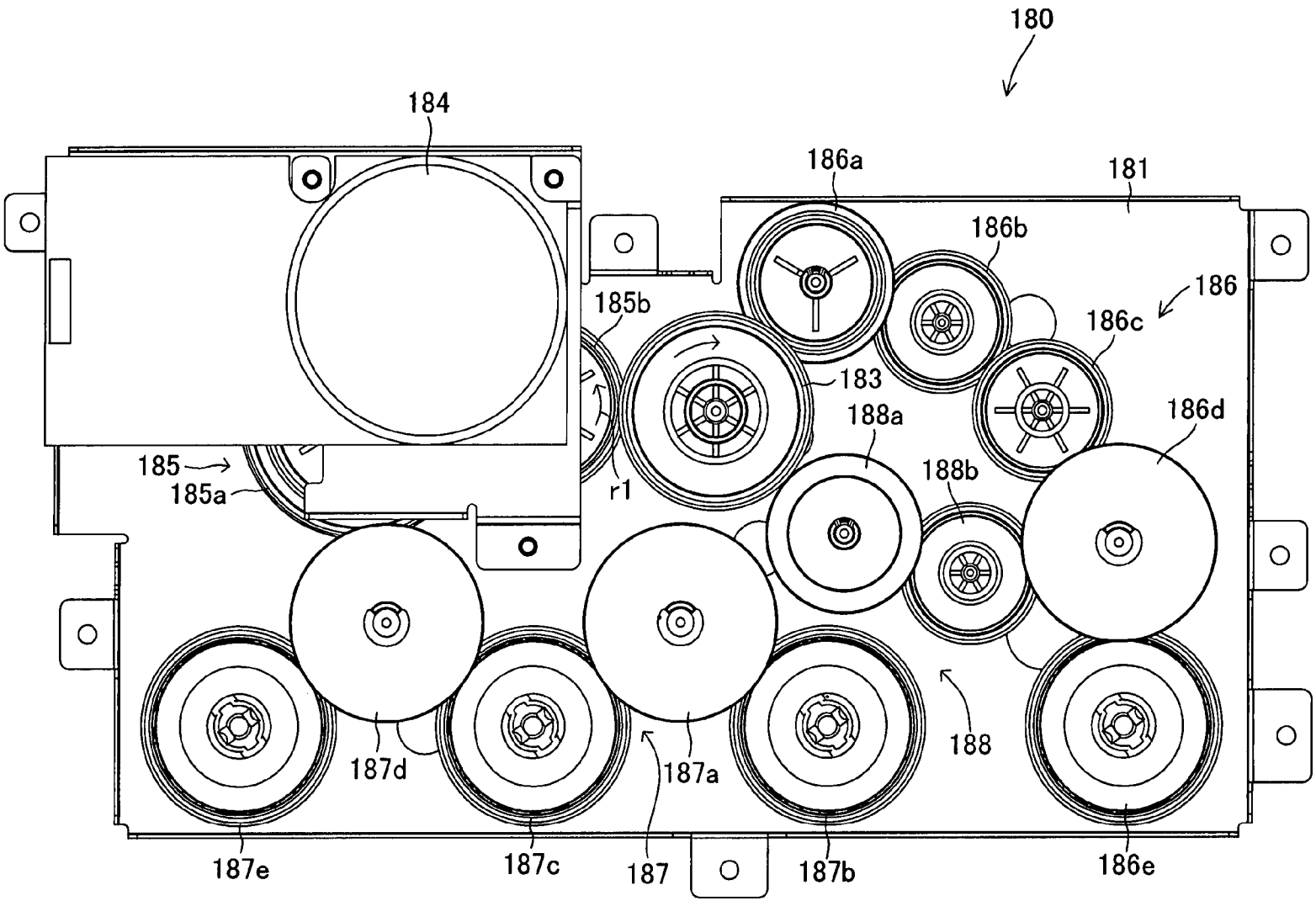
FIG. 3 is a drawing of gear trains inside the drive unit shown in FIG. 2.
Figure 4A:
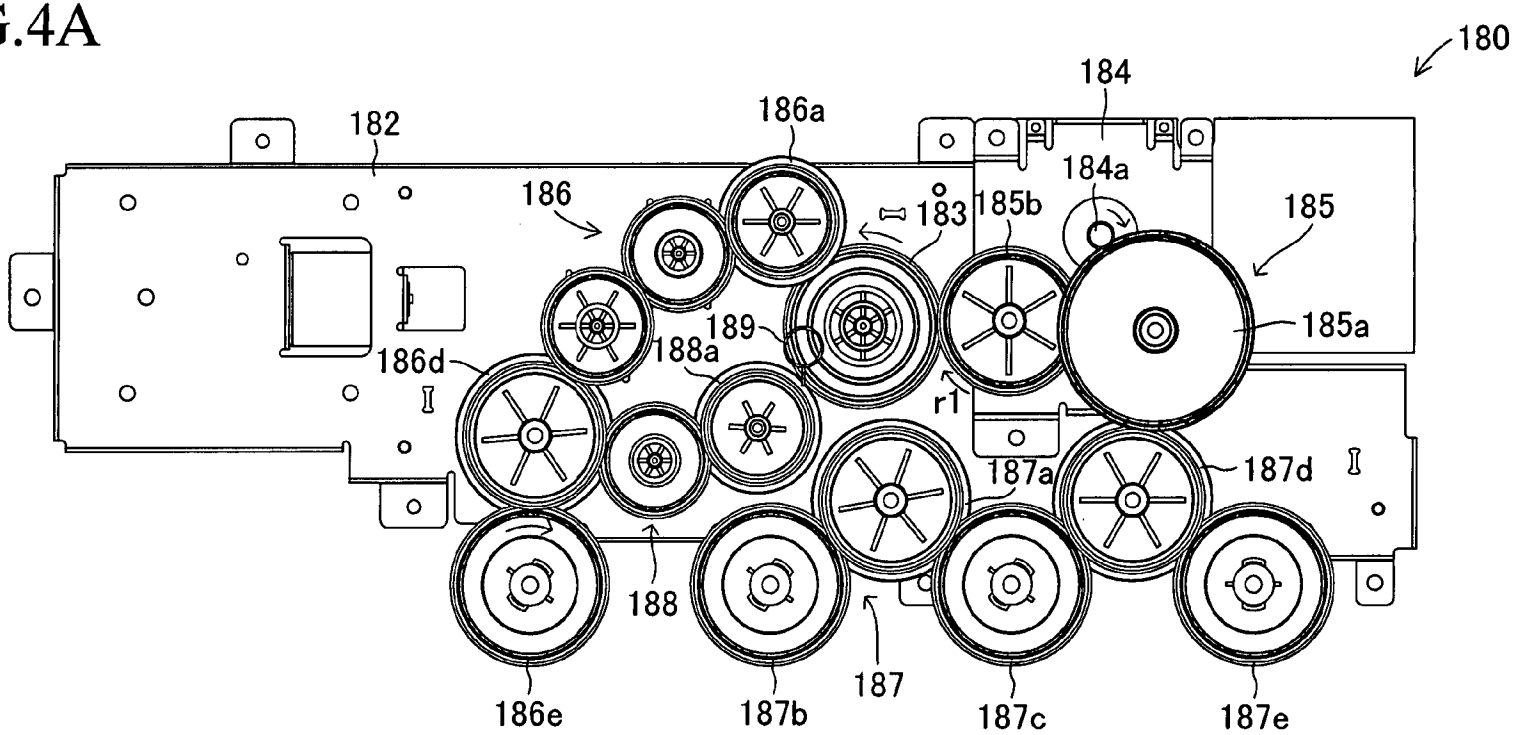
FIGS. 4A and 4B are drawings of gear trains inside the drive unit shown in FIG. 2.
Figure 4B:
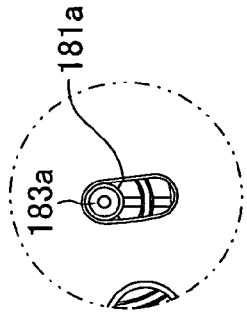
Figure 5:
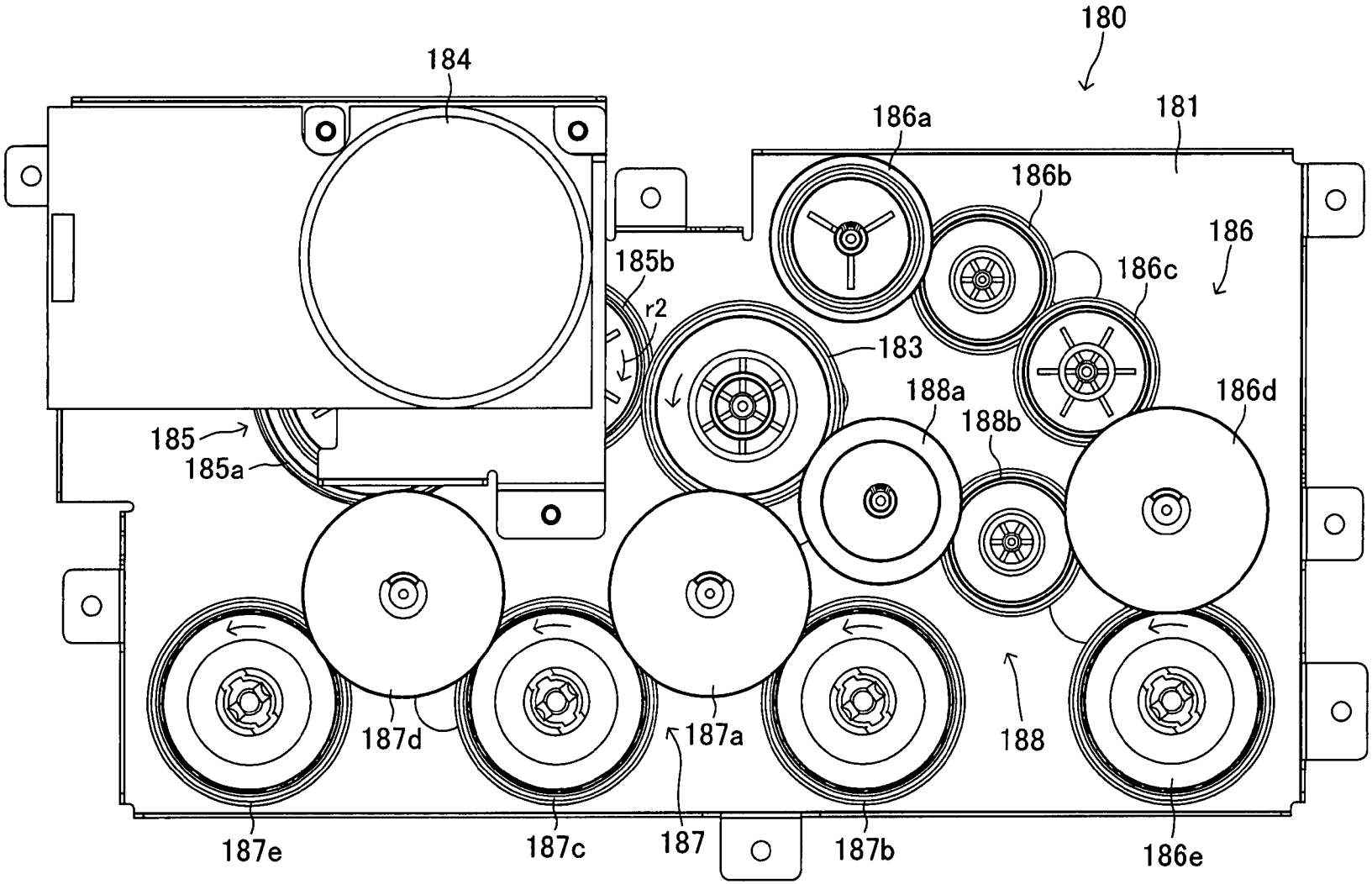
FIG. 5 is a drawing of gear trains inside the drive unit shown in FIG. 2.
Figure 6A:
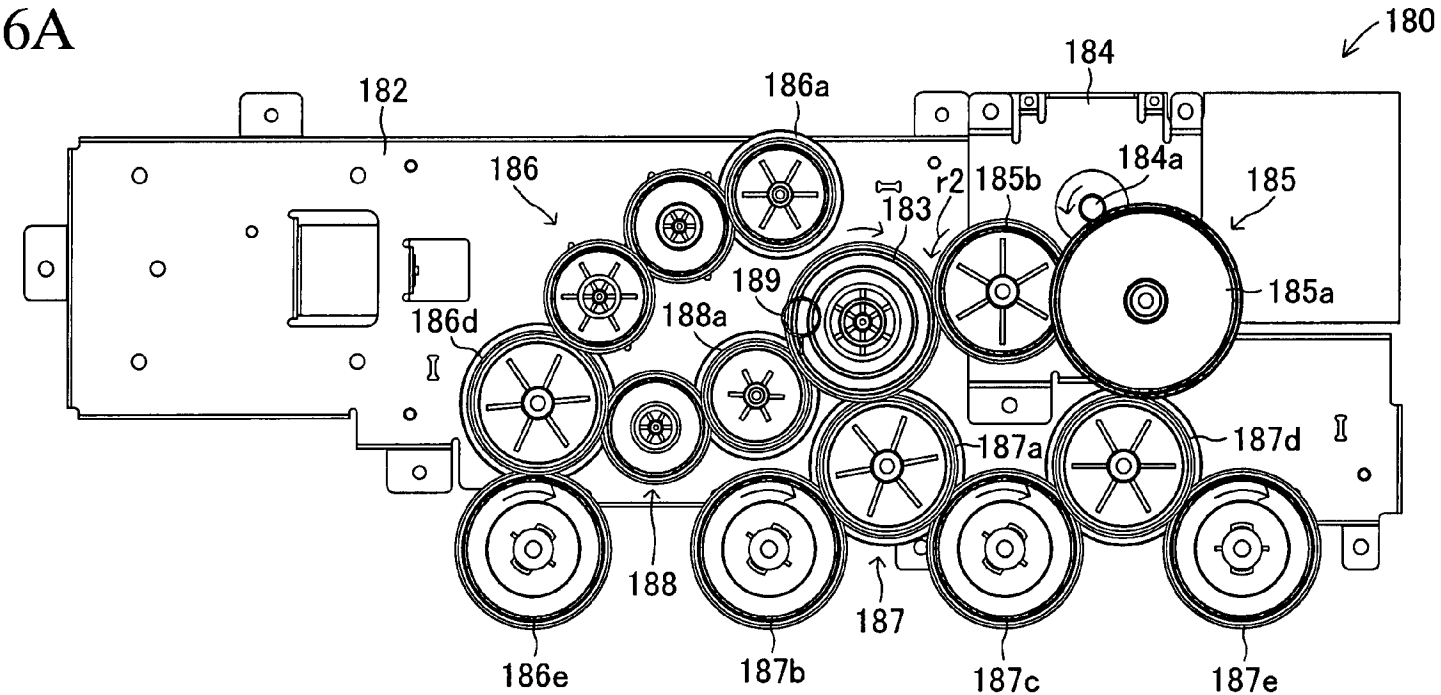
FIGS. 6A and 6B are drawings of gear trains inside the drive unit shown in FIG. 2.
Figure 6B:
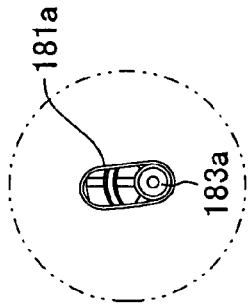

FIGS. 3 to 6B are drawings showing a gear train inside the drive unit 180. FIG. 3 is a drawing of the internal structure of the drive unit 180 viewed from the second side frame 182 in a state in that the second side frame 182 is removed. FIGS. 4A and 4B are drawings of the internal structure of the drive unit 180 viewed from the first side frame 181 in a state in that the first side frame 181 is removed. FIG. 5 is a drawing corresponding to FIG. 3 in that the swinging gear 183 is different in position from FIG. 3. FIGS. 6A and 6B are drawings corresponding to FIGS. 4A and 4B in which the swinging gear 183 is different in position from FIGS. 4A and 4B. That is, in FIGS. 3 to 4B, the swinging gear 183 is located at "first position", and in FIGS. 5 to 6B, the swinging gear 183 is located at "second position".

Referring to FIGS. 3 to 6B, the drive unit 180 according to the embodiment includes a motor 184, a primary transmission gear train 185, a first gear train 186, a second gear train 187, a third gear train 188, and a pressure spring 189, in addition to the first side frame 181, the second side frame 182, and the swinging gear 183.

(Swinging Gear/Main Gear)

The first side frame 181 is provided with an oval slide hole 181*a* formed thereon, in which a swinging gear center shaft 183*a* of the swinging gear 183 is accommodated rotatably as well as slidably in the substantially vertical direction of the drawing (this is the same as in the second side frame 182).

Referring to FIGS. 3 and 4A, the motor 184 is fixed to the second side frame 182 so as opposite the first side frame 181. The DC motor 184 is arranged at an end of the drive unit 180 (at the upper right end of FIGS. 2 and 4A/at the upper left end of FIG. 3).

Referring to FIGS. 4A and 4B, the primary transmission gear train 185 is arranged so as to mesh with a motor drive shaft gear 184*a* provided coaxially with the motor center shaft of the motor 184. This primary transmission gear train 185 is composed of an intermediate gear 185*a* and a main gear 185*b*. The intermediate gear 185*a* is arranged so as to directly mesh with the motor drive shaft gear 184*a*. The main gear 185*b* is arranged between the intermediate gear 185*a* and the swinging gear 183 so as to mesh with the intermediate gear 185*a* and the swinging gear 183.

That is, the drive unit 180 is constructed so as to be operated as follows; when the motor drive shaft gear 184*a* rotates clockwise in FIG. 4A so that the main gear 185*b* is rotated in arrow r1 direction of FIGS. 3 and 4A (first direction), the swinging gear 183 moves to the first position in an upper portion of the drawings by the swinging gear 183 urged upward in the drawings at the position where the swinging gear 183 is meshed with the main gear 185*b*. This "first position", as shown in FIG. 4B, is a position where the swinging gear 183 exists when the swinging gear center shaft 183*a* butts the upper end of the slide hole 181*a* and is shown in FIGS. 3 and 4A.

Also, the drive unit 180 is constructed so as to be operated as follows; when the motor drive shaft gear 184*a* rotates counterclockwise in FIG. 6A so that the main gear 185*b* is rotated in arrow r2 direction of FIGS. 5 and 6A (second direction), which is opposite to the arrow r1 direction, the swinging gear 183 moves to a second position in a lower portion of the drawings by the swinging gear 183 urged downward in the drawings at the position where the swinging gear 183 is meshed with the main gear 185*b*. This "second position", as shown in FIG. 6B, is a position where the swinging gear 183 exists when the swinging gear center shaft 183*a* butts the lower end of the slide hole 181*a* and is shown in FIGS. 5 and 6A.

Referring to FIGS. 2 and 4A, between the side face (the near side of the drawings) of the swinging gear 183 and the first side frame 181, the pressure spring 189 is arranged. The pressure spring 189 is a coil spring, and is fixed to the first side frame 181. The pressure spring 189 is arranged so as to apply a frictional force to the side face of the swinging gear 183 to an extent allowing the movement of the swinging gear 183 between the first and second positions due to the change in rotational direction of the motor 184. That is, with the frictional force due to the pressure spring 189, when the motor 184 is rotating in a predetermined direction, the swinging gear 183 can remain at the first or the second position.

(First Gear Train)

Referring to FIG. 3, at an end portion of the drive unit 180, which is opposite to the end portion where the motor 184 is arranged, the first gear train 186 is arranged. The first gear train 186 includes a primary intermediate gear 186*a*, a secondary intermediate gear 186*b*, a tertiary intermediate gear 186*c*, a final intermediate gear 186*d*, and a black input gear 186*e*.

The primary intermediate gear 186*a* is arranged at a position meshing with the swinging gear 183 moved to the first position. The secondary intermediate gear 186*b* is arranged between the primary intermediate gear 186*a* and the tertiary intermediate gear 186*c* so as to mesh with the primary intermediate gear 186*a* and the tertiary intermediate gear 186*c*. The tertiary intermediate gear 186*c* is arranged between the secondary intermediate gear 186*b* and the final intermediate gear 186*d* so as to mesh with the secondary intermediate gear 186*b* and the final intermediate gear 186*d*. The final intermediate gear 186*d* is arranged between the tertiary intermediate gear 186*c* and the black input gear 186*e* so as to mesh with the tertiary intermediate gear 186*c* and the black input gear 186*e*. The black input gear 186*e* is arranged at a diagonal position to the motor 184 in the drive unit 180.

The first gear train 186, as shown in FIG. 3, is constructed so as to transmit a rotational drive force generated by the motor 184 to the developing unit 134K having black toner accommodated therein (see FIG. 1) when the swinging gear 183 is moved to the first position so as to mesh with the primary intermediate gear 186*a*.

(Second Gear Train)

Referring to FIG. 5, the second gear train 187 is arranged below the motor 184 in the drawing. The second gear train 187 includes a first final intermediate gear 187*a*, a yellow input gear 187*b*, a cyan input gear 187*c*, a second final intermediate gear 187*d*, and a magenta input gear 187*e*.

The first final intermediate gear 187*a* is arranged at a position meshing with the swinging gear 183 moved to the second position. The yellow input gear 187*b* and the cyan input gear 187*c* are arranged in a lower end portion of FIG. 5 in the drive unit 180 along a straight line in which also the black input gear 186*e* is substantially aligned. The first final intermediate gear 187*a* is also arranged between the yellow input gear 187*b* and the cyan input gear 187*c* so as to mesh with the yellow input gear 187*b* and the cyan input gear 187*c*.

The second final intermediate gear 187*d* is arranged below the motor 184 and the primary transmission gear train 185 in the drawing so as to mesh with the cyan input gear 187*c*. The magenta input gear 187*e* is arranged in a substantially straight line with the black input gear 186*e*, the yellow input gear 187*b*, and the cyan input gear 187*c* and to mesh with the second final intermediate gear 187*d*. That is, the second final intermediate gear 187*d* is arranged between the cyan input gear 187*c* and the magenta input gear 187*e* so as to mesh with the cyan input gear 187*c* and the magenta input gear 187*e*.

The second gear train 187, as shown in FIG. 5, is constructed so as to transmit a rotational drive force generated by the motor 184 to the developing unit 134Y having yellow toner accommodated therein, the developing unit 134C having cyan toner accommodated therein, and the developing unit 134M having magenta toner accommodated therein (see FIG. 1) when the swinging gear 183 is moved to the second position so as to mesh with the first final intermediate gear 187*a*.

(Third Gear Train)

Referring to FIG. 5, in a space between the swinging gear 183 and the black input gear 186*e* as well as in a space between the first gear train 186 and the second gear train 187, a first intermediate gear 188*a* and a second intermediate gear 188*b* are arranged so as to constitute the third gear train 188. The first intermediate gear 188*a* and the second intermediate gear 188*b* are arranged between the swinging gear 183 and the final intermediate gear 186*d*. That is, the third gear train 188 includes the first intermediate gear 188*a*, the second intermediate gear 188*b*, the final intermediate gear 186*d*, and the black input gear 186*e*.

The first intermediate gear 188*a* is arranged at a position meshing with the swinging gear 183 moved to the second position. The second intermediate gear 188*b* is arranged between the first intermediate gear 188*a* and the final intermediate gear 186*d* so as to mesh with the first intermediate gear 188*a* and the final intermediate gear 186*d*.

The third gear train 188, as shown in FIG. 5, is constructed so as to transmit a rotational drive force generated by the motor 184 to the developing unit 134K having black toner accommodated therein (see FIG. 1) when the swinging gear 183 is moved to the second position so as to mesh with the first final intermediate gear 187*a*.

(Structure/Arrangement of Each Gear Train)

Referring to FIGS. 5 to 6B, the second gear train 187 is arranged in close vicinity to the motor 184. On the other hand, the first gear train 186 and the third gear train 188 are arranged at positions further from the motor 184 than the second gear train 187. That is, the second gear train 187 and the primary transmission gear train 185 provided to mesh with the motor drive shaft gear 184*a* are arranged in a space in the vicinity of the motor 184. In an open space outside the space occupied by the second gear train 187 and the primary transmission gear train 185 in the vicinity of the motor 184, the first gear train 186 and the third gear train 188 are arranged.

The first intermediate gear 188*a* and the second intermediate gear 188*b* constituting the third gear train 188 are arranged in the space between the first gear train 186 and the second gear train 187 as mentioned above.

The final intermediate gear 186*d* and the black input gear 186*e* constituting the third gear train 188 are included in gears constituting the first gear train 186.

In such a manner, in the drive unit 180 according to the embodiment, a number of gears are efficiently arranged within a comparatively small space.

Also, the first gear train 186, as mentioned above, is composed of the primary intermediate gear 186*a*, the secondary intermediate gear 186*b*, the tertiary intermediate gear 186*c*, the final intermediate gear 186*d*, and the black input gear 186*e*, which are five gears in total. The third gear train 188, as mentioned above, the first intermediate gear 188*a*, the second intermediate gear 188*b*, the final intermediate gear 186*d*, and the black input gear 186*e*, which are four gears in total. That is, the first gear train 186 and the third gear train 188 are configured so as to have an odd-numbered difference in the number of gears between the first gear train 186 and the third gear train 188.

The black input gear 186*e*, the yellow input gear 187*b*, the cyan input gear 187*c*, and the magenta input gear 187*e* are formed in the shame shape. That is, these gears are configured to have the same pitch circle radius and the same number of teeth.

Furthermore, the final intermediate gear 186*d*, the first final intermediate gear 187*a*, and the second final intermediate gear 187*d* are formed in the shame shape.

(Input Mechanism of Rotational Drive Force)

A specific example of the structure for inputting a rotational drive force from the drive unit 180 shown in FIGS. 2 to 6B to each image forming unit 130 shown in FIG. 1 will be described with reference to FIG. 7.

Figure 7:
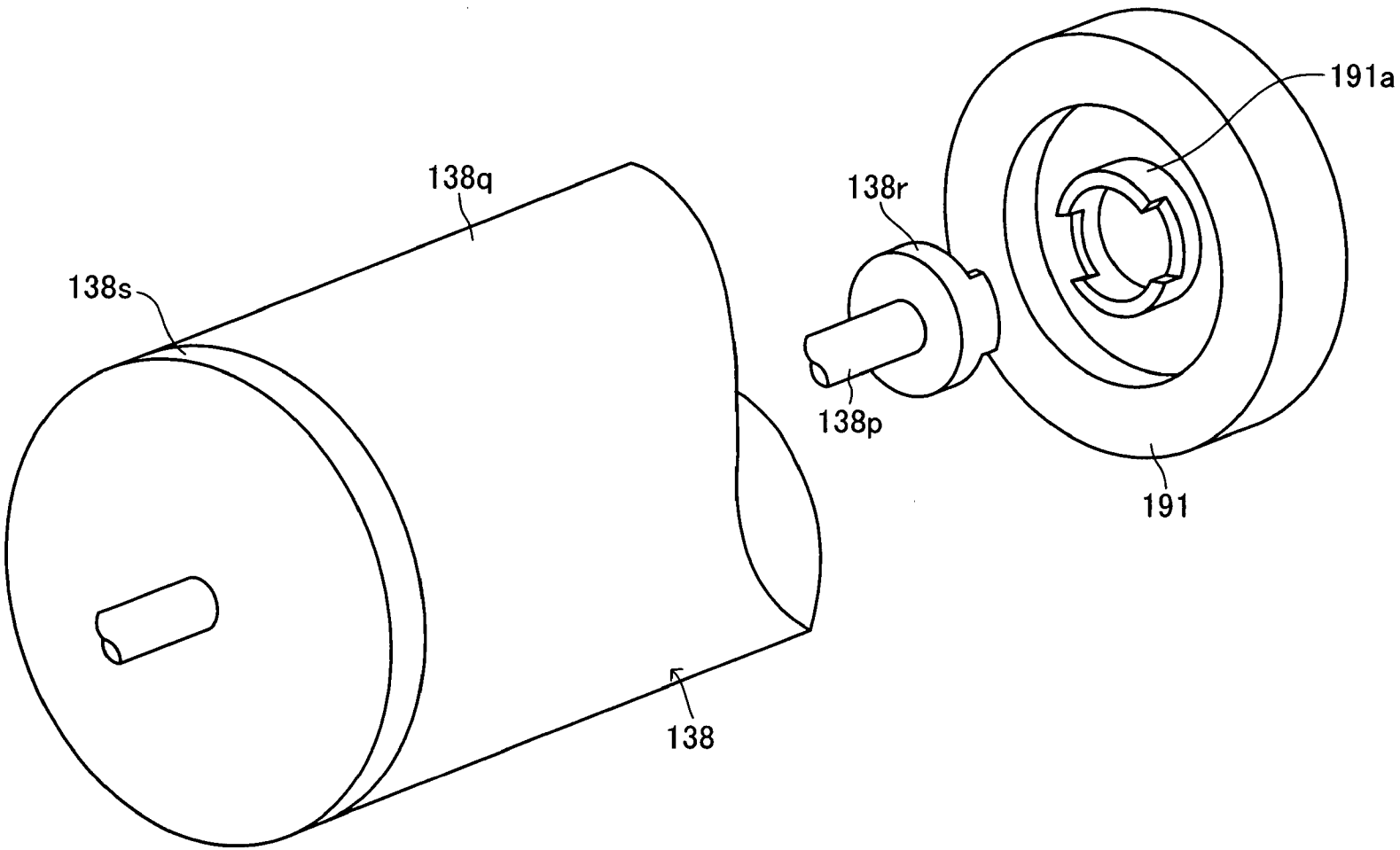
FIG. 7 is a partly enlarged perspective view of a drive force input part through which a rotational drive force is inputted from the drive unit shown FIGS. 2 to 6B into each image forming unit shown in FIG. 1.
Figure 8:
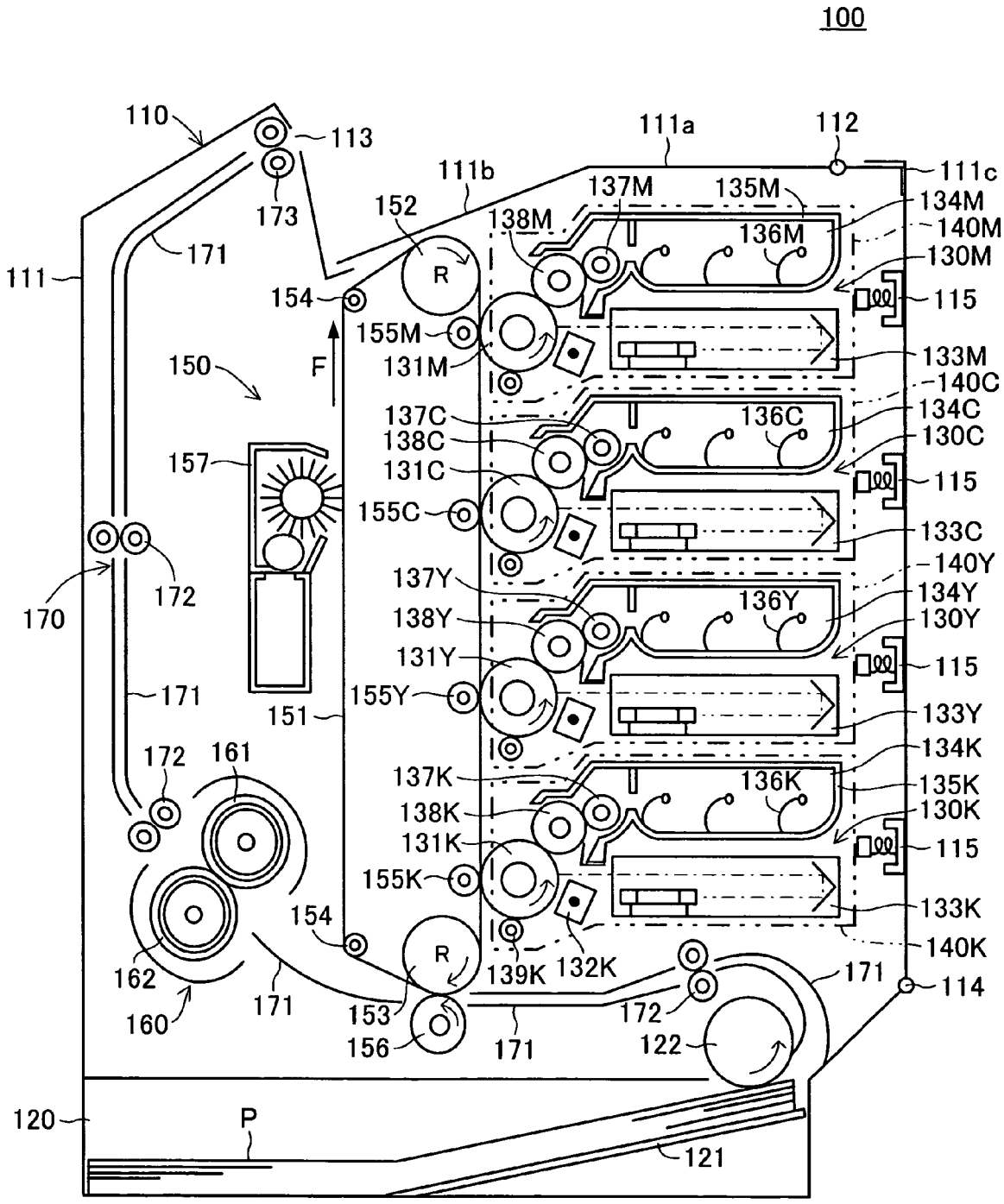
FIG. 8 is a sectional view of a modification of the color laser printer shown in FIG. 1.

An input gear 191 shown in FIG. 7 corresponds to the above-mentioned black input gear 186*e*, the yellow input gear 187*b*, the cyan input gear 187*c*, and the magenta input gear 187*e* (see FIG. 5). That is, the input gear 191 shown in FIG. 7 is an enlarged shape of an arbitrary one of these input gears. The input gear 191 is provided with a coupling 191*a* formed therein. Also, the developing roller 138, as mentioned above, is composed of a rotational center shaft 138*p* and an outer layer 138*q* formed in the periphery of the rotational center shaft 138*p*. At one end of the developing roller 138 (the rotational center shaft 138), a coupling 138*r* is fixed. The coupling 138*r* is constructed so as to transmit a rotational drive force of the input gear 191 to the developing roller 138 when it is connected to the coupling 191*a* of the input gear 191. At the other end of the developing roller 138 (the rotational center shaft 138*p*), a developing roller gear 138*s* is fixed. The developing roller gear 138*s* is arranged so as to mesh with at least any one of the gears fixed to one end of each roller member of the photosensitive drum 131 and the feed roller 137 provided in the image forming unit 130.

(Operation of Color Laser Printer of Embodiment)

Then, a schematic operation of the color laser printer 100 having the structure described above according to the embodiment will be described with reference to FIG. 1.

Referring to FIG. 1, the sheet feed roller 122 of the sheet feed section 120 is first rotated in arrow direction of the drawing. Thereby, the top sheet P of sheets placed on the sheet tray 121 is paid out due to the friction to the peripheral surface of the sheet feed roller 122. The paid out sheet P is conveyed toward the secondary transfer position with the sheet guides 171 and the sheet conveying rollers 172.

On the other hand, the belt drive rollers 152 and 153 are rotated in arrow R direction of the drawing so that the intermediate transfer belt 151 is fed in arrow F direction of the drawing.

At positions of the intermediate transfer belt 151 opposing the image forming units 130, by the electric field generated by the primary transfer bias voltage between the photosensitive drum 131 and the image forming unit 130, toner carried on the peripheral surface of the photosensitive drum 131 is once transferred onto the intermediate transfer belt 151.

The toner once transferred on the intermediate transfer belt 151 is transferred onto the sheet P at the secondary transfer position by the electric field due to the secondary transfer bias voltage between the belt drive roller 153 and the secondary transfer roller 156.

The sheet P having the toner transferred thereto when passing through the secondary transfer position is pinched between the heating roller 161 of the fixing unit 160 and the pressure roller 162, so that the sheet P is pressurized and heated, thereby melting the toner on the sheet P so as to be fixed on the sheet P.

The sheet P, which has passed through the fixing unit 160, is conveyed toward the sheet ejection rollers 173 by the sheet conveying rollers 172 while being guided by the sheet guides 171. Then, the sheet P is ejected outside the body 110 via the sheet ejection port 113 so as to be placed on the catch tray 111*b*.

(Switching Color Image Forming/Monochromatic Image Forming)

Subsequently, the switching operation between color image forming and monochromatic (black) image forming will be described with reference to the drawings.

(Monochromatic Image Forming)

Referring to FIGS. 4A and 4B, during black monochromatic image forming, the motor drive shaft gear 184*a* is rotated in arrow direction of the drawing. Then, as shown in FIGS. 3 and 4A, the main gear 185*b* is rotated in arrow r1 direction (first direction). By the rotation of the main gear 185*b* in the first direction, a force is applied to the swinging gear 183 in a direction upward of the drawing, which is the tangential direction r1 at the position of the main gear 185*b* meshing with the swinging gear 183. Thereby, as shown in FIGS. 3 and 4A, the swinging gear 183 is upward moved to the first position so as to mesh with the primary intermediate gear 186*a* of the first gear train 186.

When the main gear 185*b* is rotated in arrow r1 direction, the rotational drive force of the main gear 185*b* is transmitted only to the first gear train 186. Then, the yellow input gear 187*b*, the cyan input gear 187*c*, and the magenta input gear 187*e*, which are located at ends of the second gear train 187, are not rotated while the black input gear 186*e* located at an end of the first gear train 186 is rotated in arrow direction of FIGS. 3 and 4A. Thereby, the rotational drive force is transmitted to the developing roller 138K (see FIG. 1) via the coupling 191*a* formed in the black input gear 186*e* and the coupling 138*r* (see FIG. 7). Referring to FIG. 1, by the rotational drive force transmitted to the developing roller 138K, only the image forming unit 130K (the developing unit 134K) is driven.

On the other hand, the other image forming units 130M, 130C, and 130Y are not driven. In this case, the developing unit cases 135M, 135C, and 135Y of the image forming units 130M, 130C, and 130Y are moved on the right in the drawing. Thereby, the not driven developing rollers 138M, 138C, and 138Y are separated from the photosensitive drums 131M, 131C, and 131Y, respectively, further than predetermined positions where they are driven so as to form images.

(Color Image Forming)

Referring to FIGS. 6A and 6B, during color image forming, the motor drive shaft gear 184*a* is rotated in arrow direction of the drawing. Then, as shown in FIGS. 5 and 6A, the main gear 185*b* is rotated in arrow r2 direction of the drawing (the second direction). By the rotation of the main gear 185*b* in the second direction, a force is applied to the swinging gear 183 downward in the drawing in the tangential direction r2 at the position of the main gear 185*b* meshing with the swinging gear 183. Thereby, as shown in FIGS. 5 and 6A, the swinging gear 183 is downward moved to the second position so as to mesh with the first final intermediate gear 187*a* of the second gear train 187 and the first intermediate gear 188*a* of the third gear train 188.

When the main gear 185*b* is rotated in arrow r2 direction, the rotational drive force of the main gear 185*b* is transmitted to the second gear train 187 and the third gear train 188. Then, the yellow input gear 187*b*, the cyan input gear 187*c*, and the magenta input gear 187*e*, which are located at ends of the second gear train 187, and the black input gear 186*e* located at an end of the third gear train 188 are rotated in arrow direction of FIGS. 5 and 6A. Thereby, the rotational drive force is transmitted to the developing rollers 138M, 138C, and 138Y (see FIG. 1) via the coupling 191*a* and the coupling 138*r* formed in each input gear 186*e* (see FIG. 7). Referring to FIG. 1, by the rotational drive force transmitted to the developing rollers 138, the image forming units 130 (the developing units 134) are driven.

(Effect due to Structure of Embodiment)

Then, the effect of the structure according to the embodiment will be described with reference to the drawings.

According to the embodiment, the mode can be instantly switched easily between monochromatic image forming and color image forming only by reversing the rotational direction of the motor 184.

According to the embodiment, the switching between monochromatic image forming and color image forming can be made only by using members directly contributing to power transmission such as the motor and gears. That is, according to the embodiment, the switching between monochromatic image forming and color image forming can be made without using subsidiary mechanisms such as an electromagnetic solenoid and a cam mechanism which are not directly contributing to power transmission. Hence, the switching between monochromatic image forming and color image forming can be made with an inexpensive structure.

According to the embodiment, as described above, a number of gears are efficiently arranged within a comparatively small space. Hence, according to the embodiment, the miniaturizing of the drive unit 180 and the color laser printer 100 can be inexpensively achieved.

According to the embodiment, as described above, a DC motor is used as the motor 184. Thus, according to the embodiment, a plurality of the image forming units 130 (the developing units 134) can be stably driven by driving the second gear train 187.

According to the embodiment, the first gear train 186 and the third gear train 188 are configured so as to have an odd-numbered difference in the number of gears between the first gear train 186 and the third gear train 188. Thereby, even when the motor 184 is driven in the reverse direction, the black input gear 186*e* can be rotated in the same direction. Therefore, according to the embodiment, during the monochromatic image forming and the color image forming, the image forming unit 130K for black monochromatic image forming can be shared with a very simplified structure.

According to the embodiment, the black input gear 186*e*, the yellow input gear 187*b*, the cyan input gear 187*c*, and the magenta input gear 187*e* are formed in the same shape. Also, the final intermediate gear 186*d*, the first final intermediate gear 187*a*, and the second final intermediate gear 187*d*, which mesh with each of input gears, are formed in the same shape. Hence, according to the embodiment, by unifying the rotational states of each of input gears so as to equalize the driving states of the image forming units 130, multicolor images with stable image quality can be formed with a simplified structure.

(Suggestion of Modifications)

The embodiments and the examples described above, as mentioned above, are only the typical best mode embodiments and examples considered by the applicant (inventor) for the application time being. Hence, the present invention is not limited to the embodiments described above, so that various modifications can be obviously made within the essential scope of the invention.

Several modifications will be described below. Of course, the present invention is not limited to these modifications. The limited interpretation of the present invention on the basis of the descriptions of the embodiments, the examples, and the modifications (especially, the limited interpretation of functional elements described in Summary of the Invention on the basis of the embodiments) cannot be permitted because it is against the Patent Law and it falsely benefits copiers while badly damaging the applicant.

In the below-described modifications, like reference characters designate like elements common to the embodiments described above. The descriptions of these elements may be assisted by those in the embodiments. The combination of the modifications may be appropriately made within the range consistent with each other.

(i) The image forming apparatus applicable to the present invention is not limited to the color laser printer. For example, a multicolor printer (including two-color printer) and a multicolor copying machine (including two-color and full-color machines) may be applicable thereto.

(ii) The motor 184 according to the embodiment described above may use various kinds of motors other than the DC motor.

(iii) Each input gear 186*e* according to the embodiment described above may be directly meshed with the developing roller gear 138*s* (see FIG. 7) without a coupling therebetween.

(iv) The image forming units 130 according to the embodiment described above may be process units 140 (140M, 140C, 140Y, and 140K) detachable from the body 110.

Figure 9:
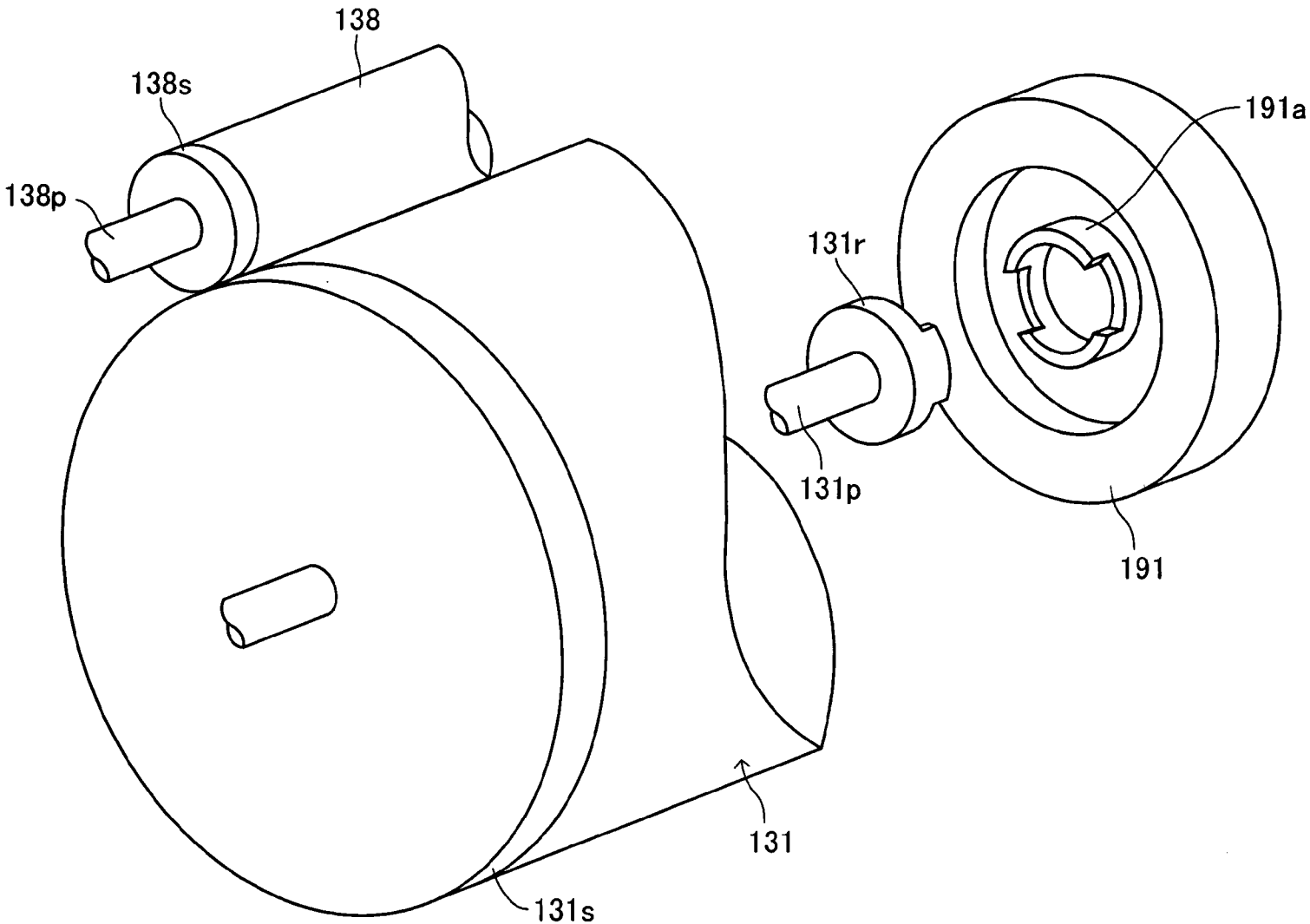
FIG. 9 is a perspective view of a modification of the drive force input part shown in FIG. 7.

(v) In the image forming apparatus and the drive unit according to the present invention, as shown in FIG. 9, the coupling 191*a* of the input gear 191 may be connected to the coupling 131*r* fixed to one end of the rotational center shaft 131*p* of the photosensitive drum 131. In this case, as shown in FIG. 9, the image forming unit 130 (the process unit 140) may be constructed so that the drum gear 131*s* fixed to the other end of the photosensitive drum 131 is meshed with the developing roller gear 138*s*.

(vi) Instead of the structure shown in FIG. 9, each of the drum gears 131*s* (see FIG. 9) fixed to ends of the photosensitive drums 131M, 131C, 131Y, and 131K may also be directly meshed with each input gear 186*e*.

Figure 10:
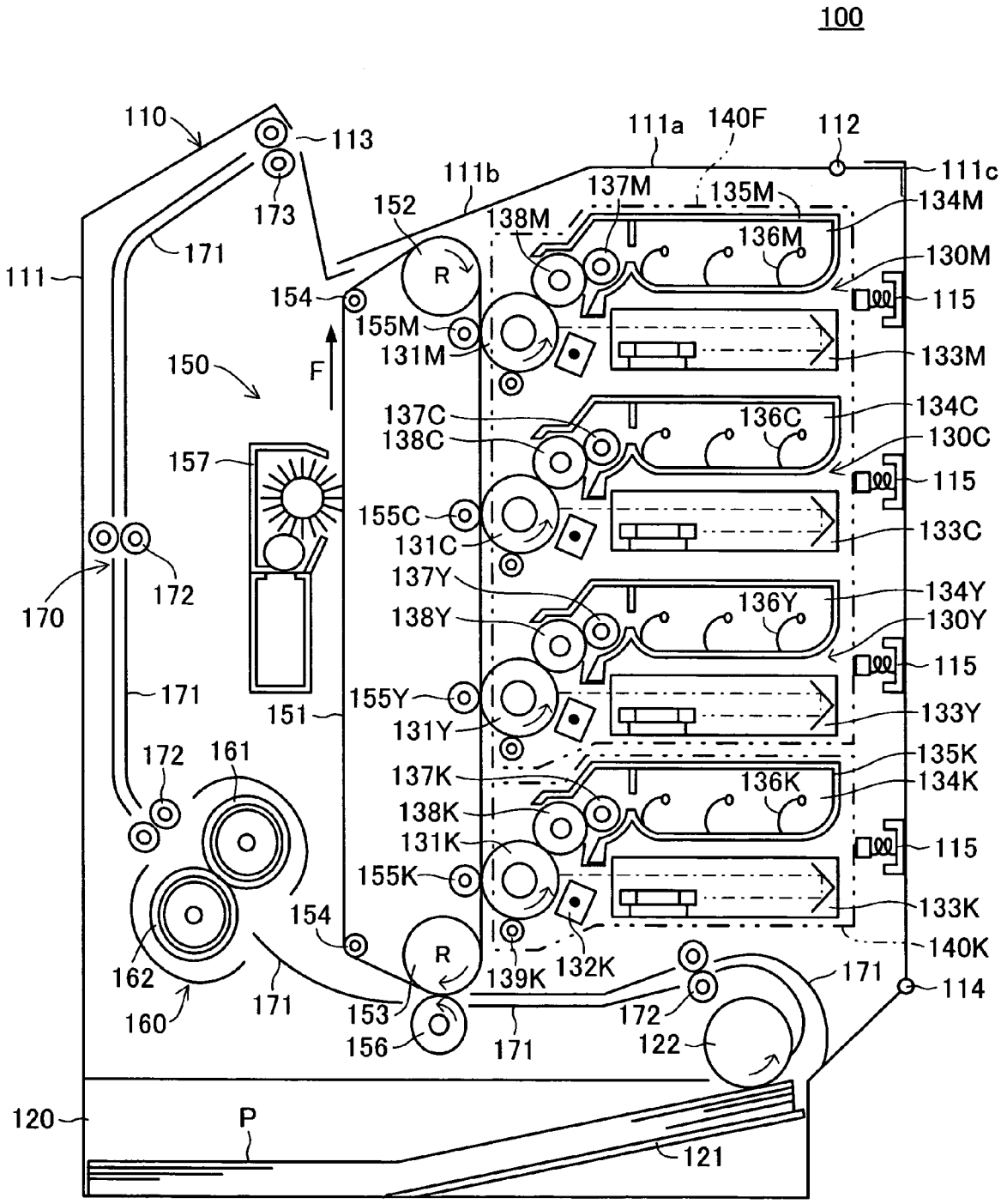
FIG. 10 is a sectional view of another modification of the color laser printer shown in FIG. 1.

(vii) As shown in FIG. 10, a black process unit 140K having the image forming unit 130K as a first process unit and a full-color process unit 140F having the image forming units 130M, 130C, and 130Y as a second process unit may also be provided detachably from the body 110.

Figure 11:
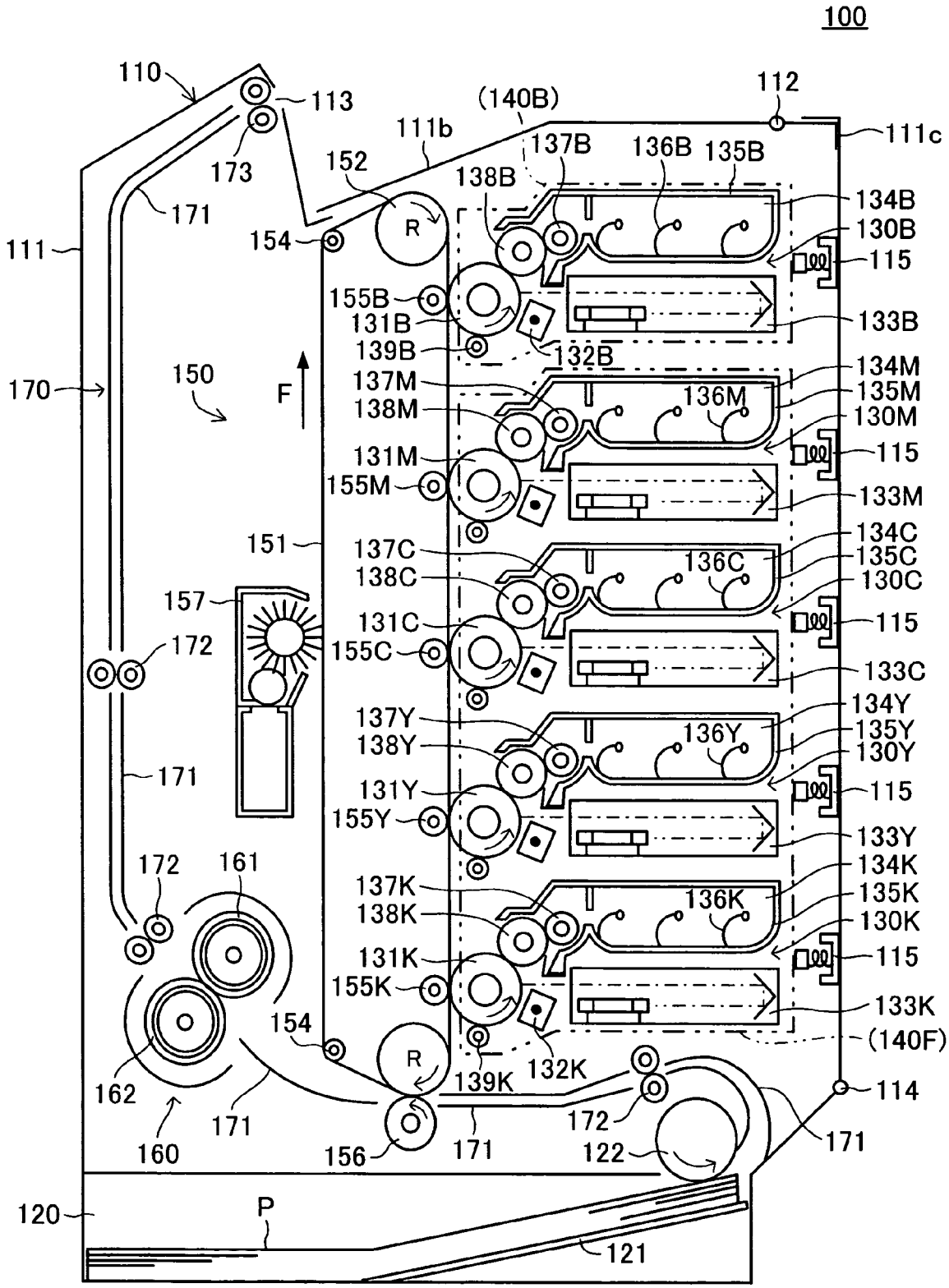
FIG. 11 is a sectional view of another modification of the color laser printer shown in FIG. 1.

(viii) As shown in FIG. 11, an image forming unit dedicated to black 130B may also be provided in addition to the black image forming unit 130K used during multicolor image forming.

The image forming unit 130B has the same structure as those of the image forming units 130M, 130C, 130Y, and 130K. That is, the image forming unit 130B includes a photosensitive drum 131B, a scorotron charger 132B, an exposure unit 133B, and a developing unit 134B. The developing unit 134B includes a developing unit case 135B, an agitator 136B, a feed roller 137B, and a developing roller 138B. The image forming unit 130B also includes a cleaning roller 139B.

Figure 12:
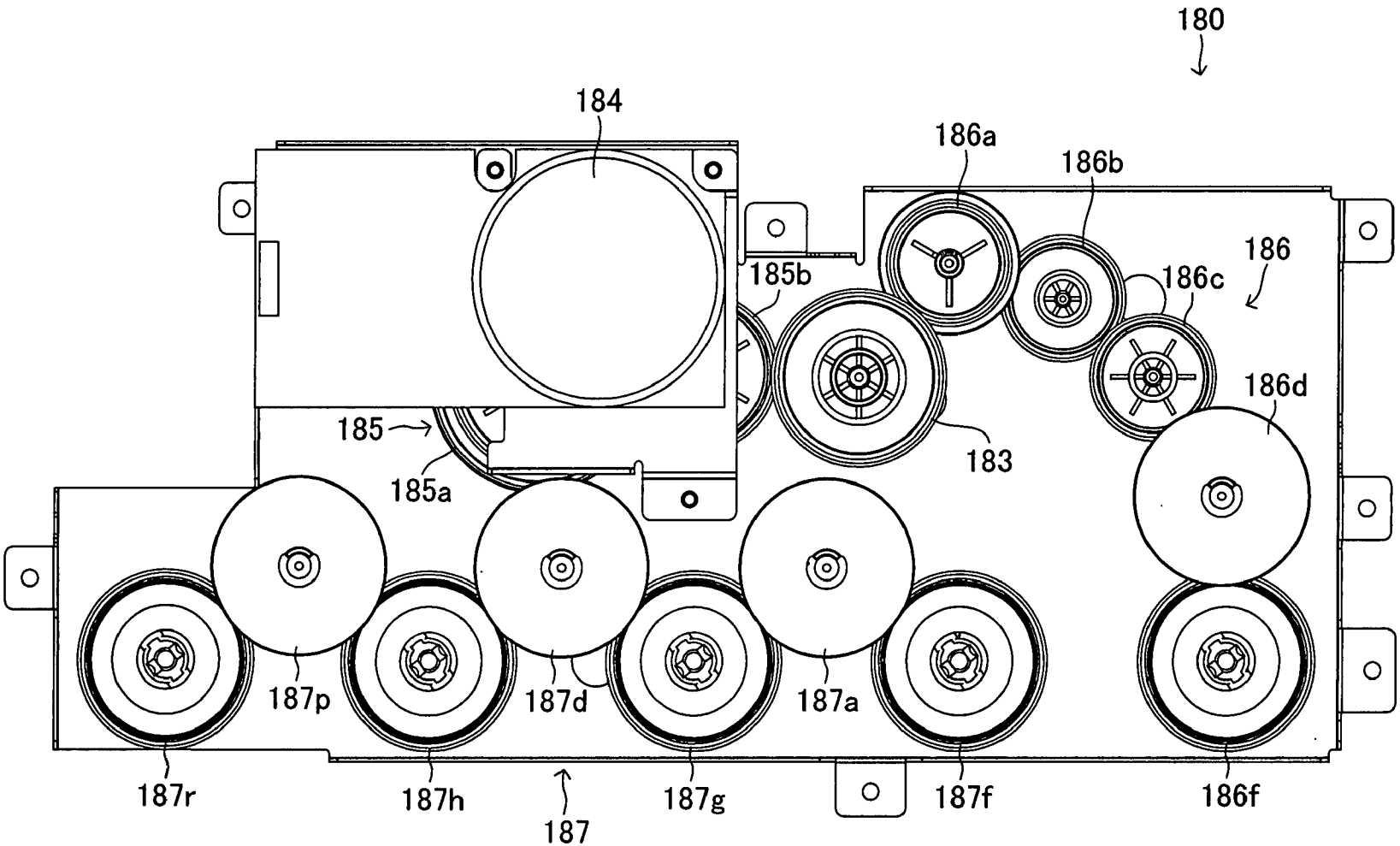
FIG. 12 is a drawing of gear trains inside a drive unit used in the modified color laser printer shown in FIG. 11.

In this case, as shown in FIG. 12, a monochromatic input gear 186*f* located at the end of the first gear train 186 is for driving the image forming unit 130B dedicated to a monochrome. The second gear train 187 is composed of a black input gear 187*f*, a yellow input gear 187*g*, a cyan input gear 187*h*, a third final intermediate gear 187*p*, and a magenta input gear 187*r*, in addition to the first final intermediate gear 187*a* and the second final intermediate gear 187*d*. In this modification, the third gear train 188 according to the embodiment described above (see FIGS. 3 to 6B) is not provided.

According to the modification, the maintenance of only the image forming unit 130B dedicated to the monochrome used very often can be independently done (part replacement and toner replenishing), improving the ease of maintenance of the color laser printer 100. Since the image forming unit 130B is driven only for monochromatic image forming, in the drive unit 180 according to the modification, the third gear train 188 according to the embodiment described above (see FIGS. 3 to 6B) is omitted, thereby further simplifying the gear configuration of the drive unit 180.

(ix) As shown in FIG. 11, when the image forming unit 130B dedicated to the monochrome is provided in addition to the black image forming unit 130K used during multicolor image forming, a process unit 140B dedicated to the monochrome having the image forming unit 130B and a full-color process unit 140F having the image forming units 130M, 130C, 130Y, and 130K may also be mounted detachably from the body 110.

(x) In addition, the functional elements described in Summary of the Invention include any structures having feasible functions other than specific structures disclosed in the embodiments and the modifications described above.

What is claimed is:

1. A drive unit of an image forming unit capable of driving a plurality of image forming units, the drive unit comprising:

a motor generating a rotational drive force;

a main gear rotatable in both forward and reverse directions in accordance with the rotational direction of the motor when the rotational drive force is transmitted thereto from the motor;

a swinging gear arranged so as to mesh with the main gear and constructed to be swingable between a first position and a second position by the rotational drive force transmitted to the main gear in accordance with the rotational direction of the motor;

a first gear train constructed so as to transmit the rotational drive force of the main gear to a first image forming unit by meshing with the swinging gear when the main gear rotating in a first direction and the swinging gear is swung to the first position by the rotation of the main gear in the first direction; and a second gear train constructed so as to transmit the rotational drive force of the main gear to a second image forming unit by meshing with the swinging gear when the main gear rotating in a second direction and the swinging gear is swung to the second position by the rotation of the main gear in the second direction.

2. The unit according to claim 1, further comprising a third gear train constructed so as to transmit the rotational drive force of the main gear to the first image forming unit by meshing with the swinging gear when the main gear rotating in the second direction and the swinging gear is swung to the second position by the rotation of the main gear in the second direction, wherein the first gear train and the third gear train are configured so as to have an odd-numbered difference in the number of gears between the first gear train and the third gear train.

3. The unit according to claim 2, wherein the first gear train and the third gear train are arranged at positions separated from the motor further than that of the second gear train.

4. The unit according to claim 3, wherein a plurality of gears constituting the third gear train partly include a gear constituting the first gear train.

5. The unit according to claim 4, wherein the first gear train includes a first input gear arranged opposite the first image forming unit constructed so as to input the rotational drive force thereto and the second gear train includes a second input gear arranged opposite the second image forming unit constructed so as to input the rotational drive force thereto, and wherein the first input gear and the second input gear are configured to have the same pitch circle diameter.

6. The unit according to claim 5, wherein the first input gear and the second input gear are configured to have the same number of teeth.

7. The unit according to claim 6, wherein the motor is a DC motor.

8. The unit according to claim 1, wherein the first gear train includes a first input gear arranged opposite the first image forming unit constructed so as to input the rotational drive force thereto and the second gear train includes a second input gear arranged opposite the second image forming unit constructed so as to input the rotational drive force thereto, and wherein the first input gear and the second input gear are configured to have the same pitch circle diameter.

9. The unit according to claim 8, wherein the first input gear and the second input gear are configured to have the same number of teeth.

10. The unit according to claim 9, wherein the motor is a DC motor.

11. An image forming apparatus capable of switching a mode between black monochromatic image forming and multicolor image forming using a plurality of image forming units, the image forming apparatus comprising:

a drive unit for generating a rotational drive force so as to transmit the rotational drive force to the plurality of image forming units;

a first-color image forming unit as the image forming unit having a first drive force input part constructed so as to receive the rotational drive force from the drive unit and a black developer accommodated therein as a first-color developer;

a second-color image forming unit as the image forming unit having a second drive force input part constructed so as to receive the rotational drive force from the drive unit and a second-color developer accommodated therein; and a third-color image forming unit as the image forming unit having a third drive force input part constructed so as to receive the rotational drive force from the drive unit and a third-color developer accommodated therein, which is different from the first- and second-color developers, wherein the drive unit includes:

a motor generating the rotational drive force;

a main gear rotatable in both forward and reverse directions in accordance with the rotational direction of the motor when the rotational drive force is transmitted thereto from the motor;

a swinging gear arranged so as to mesh with the main gear and constructed to be swingable between a first position and a second position by the rotational drive force transmitted to the main gear in accordance with the rotational direction of the motor;

a first gear train constructed so as to transmit the rotational drive force of the main gear to the first drive force input part by meshing with the swinging gear when the main gear rotating in the first direction and the swinging gear is swung to the first position by the rotation of the main gear in the first direction; and a second gear train constructed so as to transmit the rotational drive force of the main gear to the second and third drive force input parts by meshing with the swinging gear when the main gear rotating in the second direction and the swinging gear is swung to the second position by the rotation of the main gear in the second direction.

12. The apparatus according to claim 11, further comprising a third gear train constructed so as to transmit the rotational drive force of the main gear to the first drive force input part by meshing with the swinging gear when the main gear rotating in the second direction and the swinging gear is swung to the second position by the rotation of the main gear in the second direction, wherein the first gear train and the third gear train are configured so as to have an odd-numbered difference in the number of gears between the first gear train and the third gear train.

13. The apparatus according to claim 12, wherein the first gear train and the third gear train are arranged at positions separated from the motor further than that of the second gear train.

14. The apparatus according to claim 13, wherein a plurality of gears constituting the third gear train partly include a gear constituting the first gear train.

15. The apparatus according to claim 14, wherein the first-color image forming unit is comprised of a first-color developing unit capable of developing electrostatic latent images with the black developer, wherein the second-color image forming unit is comprised of a second-color developing unit capable of developing electrostatic latent images with the second-color developer, and wherein the third-color image forming unit is comprised of a third-color developing unit capable of developing electrostatic latent images with the third-color developer.

16. The apparatus according to claim 15, further comprising:

a first process unit having the first-color developing unit detachably accommodated therein and a first-color image carrying drum constructed so as to form electrostatic latent images on its peripheral surface and arranged opposite the first-color developing unit; and a second process unit having the second-color developing unit and the third-color developing unit detachably accommodated therein, a second-color image carrying drum constructed so as to form electrostatic latent images on its peripheral surface and arranged opposite the second-color developing unit, and a third-color image carrying drum constructed so as to form electrostatic latent images on its peripheral surface and arranged opposite the third-color developing unit.

17. The apparatus according to claim 16, wherein the first drive force input part is connected to a first-color drum gear fixed to an end of the first-color image carrying drum in its longitudinal direction so as to transmit the rotational drive force from the drive unit to the first-color developing unit, wherein the second drive force input part is connected to a second-color drum gear fixed to an end of the second-color image carrying drum in its longitudinal direction so as to transmit the rotational drive force from the drive unit to the second-color developing unit, and wherein the third drive force input part is connected to a third-color drum gear fixed to an end of the third-color image carrying drum in its longitudinal direction so as to transmit the rotational drive force from the drive unit to the third-color developing unit.

18. The apparatus according to claim 17, wherein the first gear train includes a first input gear arranged to be connected to the first drive force input part, and the second gear train includes a second input gear arranged to be connected to the second drive force input part and a third input gear arranged to be connected to the third drive force input part, and wherein the first input gear, the second input gear, and the third input gear are configured to have the same pitch circle diameter.

19. The apparatus according to claim 18, wherein the first input gear, the second input gear, and the third input gear are configured to have the same number of teeth.

20. The apparatus according to claim 19, wherein the motor is a DC motor.

21. The apparatus according to claim 14, wherein the image forming unit includes a process unit detachably mounted on the body of the image forming apparatus and having an image carrying drum capable of forming electrostatic latent images on its peripheral surface and a developing unit capable of developing the electrostatic latent images on the peripheral surface of the image carrying drum and arranged opposite the image carrying drum.

22. The apparatus according to claim 21, wherein the first-color image forming unit includes a first-color process unit having a first-color developing unit capable of developing electrostatic latent images with the black developer and a first-color image carrying drum arranged opposite the first-color developing unit, wherein the second-color image forming unit includes a second-color process unit having a second-color developing unit capable of developing electrostatic latent images with the second-color developer and a second-color image carrying drum arranged opposite the second-color developing unit, wherein the third-color image forming unit includes a third-color process unit having a third-color developing unit capable of developing electrostatic latent images with the third-color developer and a third-color image carrying drum arranged opposite the third-color developing unit, wherein the first drive force input part is connected to a first-color drum gear fixed to an end of the first-color image carrying drum in its longitudinal direction so as to transmit the rotational drive force from the drive unit to the first-color developing unit, wherein the second drive force input part is connected to a second-color drum gear fixed to an end of the second-color image carrying drum in its longitudinal direction so as to transmit the rotational drive force from the drive unit to the second-color developing unit, and wherein the third drive force input part is connected to a third-color drum gear fixed to an end of the third-color image carrying drum in its longitudinal direction so as to transmit the rotational drive force from the drive unit to the third-color developing unit.

23. The apparatus according to claim 22, wherein the first gear train includes a first input gear arranged to be connected to the first drive force input part, and the second gear train includes a second input gear arranged to be connected to the second drive force input part and a third input gear arranged to be connected to the third drive force input part, and wherein the first input gear, the second input gear, and the third input gear are configured to have the same pitch circle diameter.

24. The apparatus according to claim 23, wherein the first input gear, the second input gear, and the third input gear are configured to have the same number of teeth.

25. The apparatus according to claim 24, wherein the motor is a DC motor.

26. The apparatus according to claim 11, wherein the second-color image forming unit includes the black developer accommodated therein as the second-color developer.

27. The apparatus according to claim 26, wherein the first-color image forming unit is comprised of a first-color developing unit capable of developing electrostatic latent images with the black developer, wherein the second-color image forming unit is comprised of a second-color developing unit capable of developing electrostatic latent images with the second-color developer, and wherein the third-color image forming unit is comprised of a third-color developing unit capable of developing electrostatic latent images with the third-color developer.

28. The apparatus according to claim 27, further comprising:

a first process unit having the first-color developing unit detachably accommodated therein and a first-color image carrying drum constructed so as to form electrostatic latent images on its peripheral surface and arranged opposite the first-color developing unit; and a second process unit having the second-color developing unit and the third-color developing unit detachably accommodated therein, a second-color image carrying drum constructed so as to form electrostatic latent images on its peripheral surface and arranged opposite the second-color developing unit, and a third-color image carrying drum constructed so as to form electrostatic latent images on its peripheral surface and arranged opposite the third-color developing unit.

29. The apparatus according to claim 28, wherein the first drive force input part is connected to a first-color drum gear fixed to an end of the first-color image carrying drum in its longitudinal direction so as to transmit the rotational drive force from the drive unit to the first-color developing unit, wherein the second drive force input part is connected to a second-color drum gear fixed to an end of the second-color image carrying drum in its longitudinal direction so as to transmit the rotational drive force from the drive unit to the second-color developing unit, and wherein the third drive force input part is connected to a third-color drum gear fixed to an end of the third-color image carrying drum in its longitudinal direction so as to transmit the rotational drive force from the drive unit to the third-color developing unit.

30. The apparatus according to claim 29, wherein the first gear train includes a first input gear arranged to be connected to the first drive force input part, and the second gear train includes a second input gear arranged to be connected to the second drive force input part and a third input gear arranged to be connected to the third drive force input part, and wherein the first input gear, the second input gear, and the third input gear are configured to have the same pitch circle diameter.

31. The apparatus according to claim 30, wherein the first input gear, the second input gear, and the third input gear are configured to have the same number of teeth.

32. The apparatus according to claim 31, wherein the motor is a DC motor.

33. The apparatus according to claim 26, wherein the image forming unit includes a process unit detachably mounted on the body of the image forming apparatus and having an image carrying drum capable of forming electrostatic latent images on its peripheral surface and a developing unit capable of developing the electrostatic latent images on the peripheral surface of the image carrying drum and arranged opposite the image carrying drum.

34. The apparatus according to claim 33, wherein the first-color image forming unit includes a first-color process unit having a first-color developing unit capable of developing electrostatic latent images with the black developer and a first-color image carrying drum arranged opposite the first-color developing unit, wherein the second-color image forming unit includes a second-color process unit having a second-color developing unit capable of developing electrostatic latent images with the second-color developer and a second-color image carrying drum arranged opposite the second-color developing unit, wherein the third-color image forming unit includes a third-color process unit having a third-color developing unit capable of developing electrostatic latent images with the third-color developer and a third-color image carrying drum arranged opposite the third-color developing unit, wherein the first drive force input part is connected to a first-color drum gear fixed to an end of the first-color image carrying drum in its longitudinal direction so as to transmit the rotational drive force from the drive unit to the first-color developing unit, wherein the second drive force input part is connected to a second-color drum gear fixed to an end of the second-color image carrying drum in its longitudinal direction so as to transmit the rotational drive force from the drive unit to the second-color developing unit, and wherein the third drive force input part is connected to a third-color drum gear fixed to an end of the third-color image carrying drum in its longitudinal direction so as to transmit the rotational drive force from the drive unit to the third-color developing unit.

35. The apparatus according to claim 34, wherein the first gear train includes a first input gear arranged to be connected to the first drive force input part, and the second gear train includes a second input gear arranged to be connected to the second drive force input part and a third input gear arranged to be connected to the third drive force input part, and wherein the first input gear, the second input gear, and the third input gear are configured to have the same pitch circle diameter.

36. The apparatus according to claim 35, wherein the first input gear, the second input gear, and the third input gear are configured to have the same number of teeth.

37. The apparatus according to claim 36, wherein the motor is a DC motor.

* * * * *